US012590774B2

(12) United States Patent
Vegas

(10) Patent No.: US 12,590,774 B2
(45) Date of Patent: Mar. 31, 2026

(54) TRIGGER RESTRICTION DEVICE FOR CONDUCTED ENERGY DEVICES

(71) Applicant: Joseph Vegas, Lincoln, CA (US)

(72) Inventor: Joseph Vegas, Lincoln, CA (US)

(73) Assignee: Joseph Vegas, Lincoln, CA (US)

( * ) Notice: Subject to any disclaimer, the term of this patent is extended or adjusted under 35 U.S.C. 154(b) by 0 days.

(21) Appl. No.: 18/397,903

(22) Filed: Dec. 27, 2023

(65) Prior Publication Data

US 2025/0012534 A1 Jan. 9, 2025

Related U.S. Application Data

(63) Continuation-in-part of application No. 17/815,556, filed on Jul. 27, 2022, now abandoned.

(60) Provisional application No. 63/363,930, filed on Apr. 29, 2022, provisional application No. 63/226,154, filed on Jul. 27, 2021.

(51) Int. Cl.
*F41A 17/54* (2006.01)
*F41H 13/00* (2006.01)

(52) U.S. Cl.
CPC ..... *F41A 17/54* (2013.01); *F41H 13/0012* (2013.01)

(58) Field of Classification Search
CPC ..... F41A 17/54; F41A 99/00; F41A 19/11
See application file for complete search history.

(56) References Cited

U.S. PATENT DOCUMENTS

| | | | | | |
|---|---|---|---|---|---|
| 1,563,250 | A * | 11/1925 | Capon | F41A 17/54 | 42/70.07 |
| 2,401,482 | A * | 6/1946 | Hendey | F41A 17/54 | 42/70.07 |
| 2,444,649 | A * | 7/1948 | Jacobs | F41A 17/54 | 42/70.07 |
| 2,948,978 | A * | 8/1960 | Salverda | F41A 17/54 | 42/70.07 |
| 5,926,989 | A | 7/1999 | Oliver, Sr. | | |
| 9,958,225 | B1 * | 5/2018 | Richetti | F41A 17/46 | |
| D849,176 | S | 5/2019 | Luth | | |
| 10,514,221 | B2 | 12/2019 | Richetti | | |
| 11,732,993 | B2 * | 8/2023 | Laughlin | F41A 19/11 | 42/117 |
| 2011/0047849 | A1 | 3/2011 | Brenner | | |
| 2016/0109203 | A1 * | 4/2016 | Madia, II | F41A 17/54 | 42/70.07 |
| 2019/0063858 | A1 * | 2/2019 | Richetti | F41A 17/54 | |

(Continued)

FOREIGN PATENT DOCUMENTS

GB 190906761 3/1909

*Primary Examiner* — Jonathan C Weber
(74) *Attorney, Agent, or Firm* — Jonathan Kidney; Glen Gross; Intelink Law Group, PC

(57) ABSTRACT

A trigger restriction device for use with a conducted energy device (CED), contains a blocking member, an attachment member integrally connected to a top of the blocking member and oriented non-parallel to the blocking member, and an adhesion section on an outer surface of the attachment member, configured to adhere the attachment member to an inside of a trigger well when the attachment member is placed against a wall of the trigger well. When the trigger restriction device is attached to a CED, the blocking member is operably configured to block access to the trigger well on one side of the CED while allowing access to the trigger well on an opposing side of the CED.

20 Claims, 29 Drawing Sheets

(56) References Cited

U.S. PATENT DOCUMENTS

| | | | | |
|---|---|---|---|---|
| 2019/0346225 | A1* | 11/2019 | Richetti | F41A 17/063 |
| 2021/0372724 | A1* | 12/2021 | Richetti | F41A 17/06 |
| 2022/0307790 | A1* | 9/2022 | Laughlin | F41A 19/10 |
| 2024/0027154 | A1* | 1/2024 | Richetti | F41A 17/063 |

* cited by examiner

TRIGGER RESTRICTION DEVICE FOR CONDUCTED ENERGY DEVICES

CROSS-REFERENCE TO RELATED APPLICATION(S)

This application is a Continuation-in-Part application and claims the benefit of U.S. non-provisional patent application Ser. No. 17/815,556, filed Jul. 27, 2022, titled "Trigger Restriction Device for Conducted Energy Devices," which claims priority to U.S. Provisional Patent Application Nos. 63/226,154 filed Jul. 27, 2021, and 63/363,930 filed Apr. 29, 2022, the contents of which are hereby incorporated by reference in their entireties.

FIELD

This invention relates to a trigger device for conducted energy devices (CED). More particularly, it relates to a trigger restriction device for CEDs which are less than lethal electronic weapons.

BACKGROUND

Law enforcement personnel often have both a lethal and non-lethal weapon at their immediate disposal. Depending on the threat scenario, the operator will use the appropriate weapon. However, these different weapons often are confusingly similar in form. Accordingly, during a confrontation, the operator may seek to use a non-lethal weapon, but because of being rushed or in the "heat of the moment," may accidently select the lethal weapon by mistake. This accidental selection will endanger the target person's life and as well as his life, when the wrong weapon is fired. To avoid this possibility, a unique trigger restriction device (TRD) is presented that is designed for "orientation" based fitment over or into a non-lethal weapon's trigger well. Typically, the operator trains with a TRD-equipped non-lethal weapon with the non-dominant hand or support hand, so as to make it instinctive that the non-dominant hand is for the non-lethal weapon and the dominant hand is for the lethal weapon. By training with the TRD, this relationship will reduce accidental use of a lethal weapon when a non-lethal weapon was desired. The TRD's of the present invention combined with training will prevent accidental deaths. Various aspects of embodiments of this device and use are elaborated in the following figures and detailed description.

SUMMARY

The following presents a simplified summary to provide a basic understanding of some aspects of the claimed subject matter. This summary is not an extensive overview and is not intended to identify key or critical elements or to delineate the scope of the claimed subject matter. Its purpose is to present some concepts in a simplified form as a prelude to the more detailed description that is presented later.

In one aspect of the disclosed embodiments, a trigger restriction device for use with a conducted energy device (CED), the CED having a trigger, a first side and a second side and further having a trigger well defining a trigger well opening from the first side to the second side, the trigger well having an inside wall, wherein fingers on a primary hand or a non-primary hand of a user of the CED are able engage the trigger via the trigger well if provided, comprising: a blocking member; an attachment member connected to the blocking member and oriented non-parallel to the blocking member, the attachment member having an outer surface; a fastener disposed on the outer surface of the attachment member, the fastener being operably configured to attach to the inside wall of the trigger well when the device is in use; and, wherein when the device is in use the blocking member is operably configured to block a portion of the trigger well opening on the first side of the CED, wherein the fingers of the primary hand of the user is prevented from accessing the trigger well from the first side of the CED while allowing the fingers of the non-primary hand of the user to access to the trigger well from the second side of the CED.

In another aspect of the disclosed embodiments, the above device is provided, wherein the fastener is at least one of a magnet, adhesive, adhesive tape, double-sided adhesive tape, and foam-backed adhesive tape; and/or wherein the device is asymmetrical and the blocking member substantially covers the trigger opening the trigger well; and/or wherein the attachment member is oriented approximately 90 degrees from the blocking member; and/or wherein the attachment member and the blocking member are unitary, and wherein the attachment member is attached along a top edge of the blocking member; and/or wherein a length of the attachment member is smaller than a length of the blocking member; and/or wherein a width of the attachment member is less than a largest width of the blocking member; and/or wherein at least one of the blocking member and attachment member are planar in form; and/or wherein the blocking member and attachment member are integrally formed from a single material; and/or wherein the blocking member and attachment member are formed from at least one of resin, plastic, rubber, nylon, and metal; and/or further comprising one or more openings in the blocking member.

In yet another aspect of the disclosed embodiments, a trigger restriction device for use with a conducted energy device (CED), the CED having a trigger well opening with two opposing sides is provided, the trigger restriction device comprising: a blocking arm; an upper arm connected perpendicular to a top end of the blocking arm; and a top surface of the upper arm containing a contact section configured to adhere the device to an inside of a trigger well when the upper arm is placed against a wall of the trigger well, wherein the trigger restriction device when attached to the trigger well wall, the blocking member is operably configured to block access to the trigger well on one side of the CED while allowing access to the trigger well on an opposing side of the CED.

In yet another aspect of the disclosed embodiments, the above device is provided, wherein the contact section is at least one of a magnet, adhesive, adhesive tape, double-sided adhesive tape, and foam-backed adhesive tape; and/or wherein the blocking arm is longer than the upper arm; and/or wherein at least one of the blocking arm is wider than the upper arm and at least one of the blocking arm and upper arm are planar in form; and/or wherein the blocking arm and upper arm are integrally formed from a single material; and/or wherein the blocking arm and upper arm are formed from at least one of resin, plastic, rubber, nylon, and metal.

In yet another aspect of the disclosed embodiments, a trigger restriction device for use with a conducted energy device (CED), the CED having a trigger well opening with two opposing sides is provided, the trigger restriction device is provided, comprising: a blocking member having one or more openings; a top member connected to a top of the blocking member and oriented non-parallel to the blocking member; and a fastening strap is attached to at least one of the blocking member and the top member, wherein when the trigger restriction device is attached via the fastening strap to a CED, the blocking member is operably configured to block access to the trigger well on one side of the CED while allowing access to the trigger well on an opposing side of the CED.

In another aspect of the disclosed embodiments, the above device is provided, wherein the device is asymmetrical; and/or wherein the blocking arm and top arm are integrally formed from a single material from at least one of resin, plastic, rubber, nylon, and metal.

DETAILED DESCRIPTION

Various embodiments of an exemplary trigger restriction device (TRD) for conducted energy devices (CED) are described. CEDs and less than lethal electronic devices are suitable for the TRD, some of which are under the brand TASER®, which is a registered U.S. trademark of Axon Enterprise, Inc. Various embodiments provide an apparatus that obstructs, either in full or in part, access to one side of the trigger or trigger well of the CED, while leaving the other side accessible for triggering via the opposite hand. Typically, the apparatus, when implemented, operates to preclude access to the trigger of the CED on the user's Dominant-hand (Strong-hand) side. Conversely, the TRD's asymmetrical shape provides access to the CED's trigger from the user's Non-dominant hand (Support-hand or Weak-Hand) side. A benefit of having the TRD is that the user, via proper training focusing on exclusive use of the CED with his non-dominant hand, can develop muscle memory with his non-dominant hand. Thus, the user can be "trained" to instinctively use his CED with his non-dominant hand, while using his dominant had for his lethal weapon. Another benefit is if the CED is taken and used by another person who does not share the same non-dominant hand training, then operation of the CED is foiled. By these mechanisms, the user being appropriately trained will less likely accidently fire his lethal firearm when intending to fire his CED.

Figure 1:
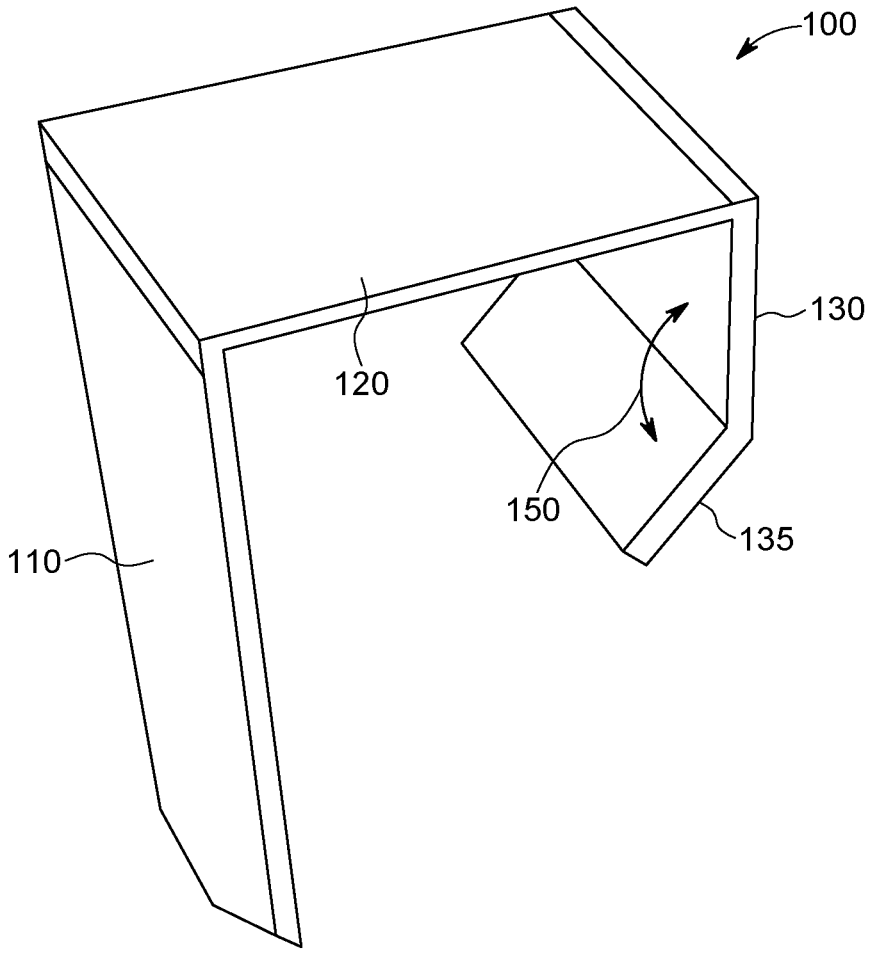
FIG. 1 is a top "front" perspective view of one possible exemplary Trigger Restriction Device (TRD), made in accordance with the present invention.
Figure 2:
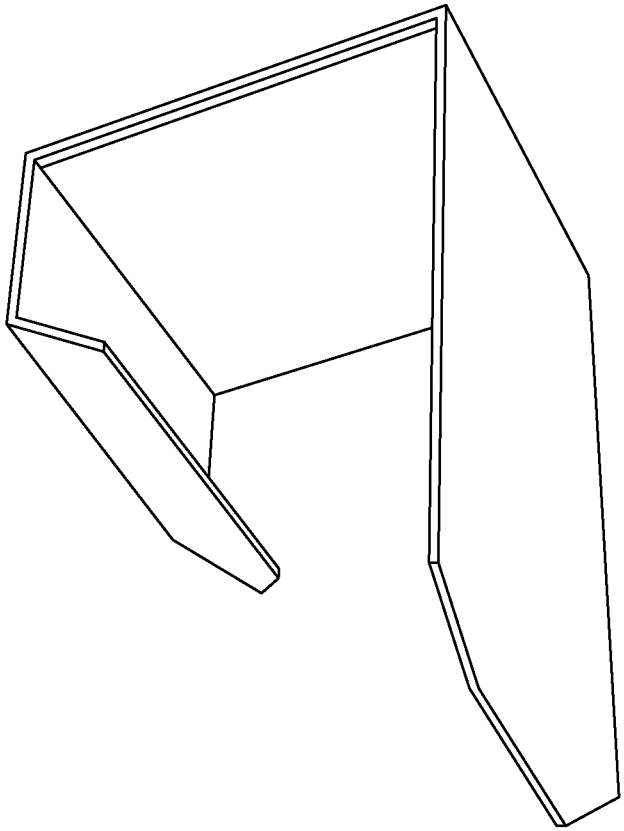
FIG. 2 is a bottom "rear" perspective view of the TRD of FIG. 1.
Figure 11:
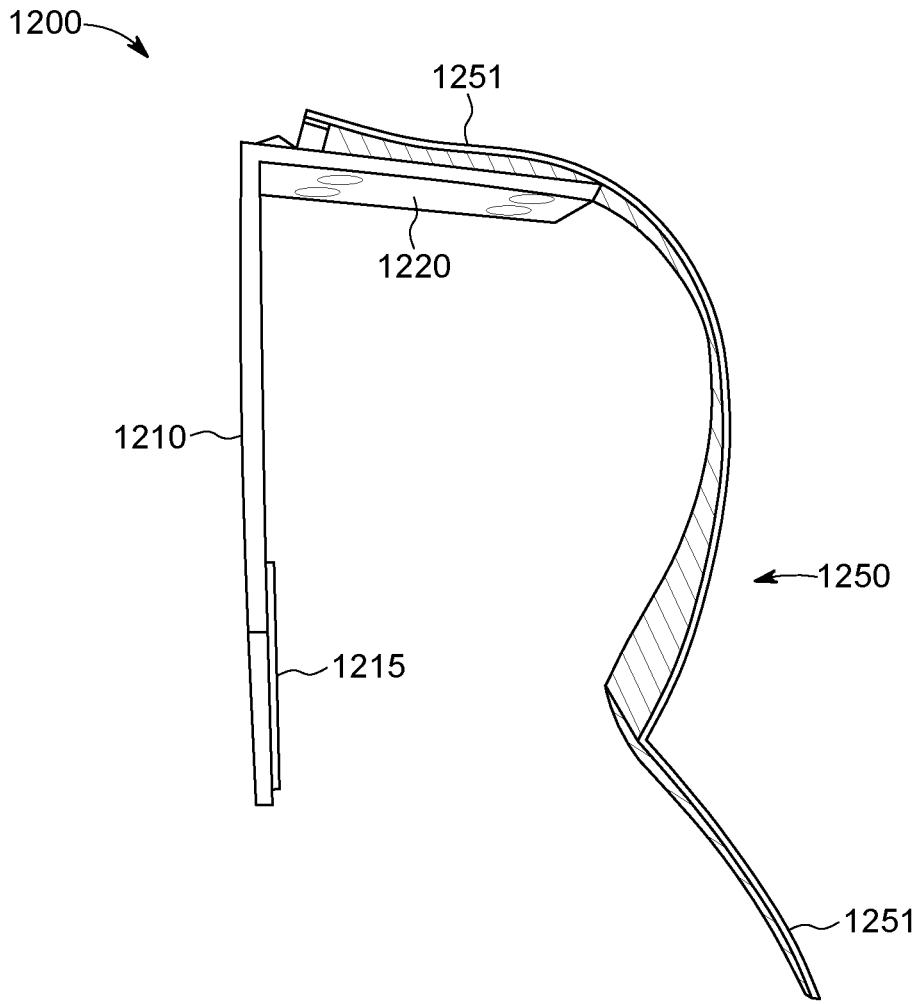
FIG. 11 shows a front view of another exemplary TRD made in accordance with the present invention.

The exemplary structure of the TRD can take several different forms. One possible form is shown in FIG. 1 where the TRD structure has the approximate appearance and general shape of a partial inverted U with one leg shorter than the other. When installed, the longer leg of the TRD "blocks" access to the CED's trigger, while the shorter leg of the TRD does not block access. FIG. 11 illustrates another possible exemplary embodiment of a TRD made in accordance with the present invention, having an inverted L shape, without a shorter leg, but with a CED flexible fastening member. Based on the dimensions and shapes used, the TRD can be removably secured to the CED by one or more attachment means. Conversely, the TRD can be removed from the CED by releasing the attachment means or, in some embodiments, pressing against the interior side of the TRD to detach it from the CED. In some embodiments, the TRD may be designed and/or attached in such a manner to allow easy purposeful removal while preventing easy accidental removal.

In some embodiments, the TRD can be sized and/or shaped to fit over the top of a CED and into the trigger well, or fitted directly into the trigger well, so one side of the CED's trigger well is blocked, while the other side is open. As mentioned above, if one side of the CED's trigger well is associated with the non-dominant hand of the user, then a properly installed TRD will prevent dominant hand triggering of the CED, while allowing non-dominant hand triggering. The exemplary TRD can be described as a trigger blocking device but only for one side. Thus, use of a "blocked" CED can be achieved by simply switching hands. It should be appreciated that while the examples here are provided in the context of non-dominant use of use, it is possible to reverse the TRD's installation to provide dominant hand use of the CED, if so desired.

It is expressly understood the CEDs illustrated in this application may not be drawn to scale or have all the details of a functioning CED. It is also noted, such a CED may be a non-functioning, demonstration model or dummy CED, for example, when used for training purposes.

The various exemplary embodiments of the TRD can be manufactured from stock using a resin material, or other similar functioning materials, plastic, rubber, nylon, etc. Of course, metals or other materials may be used, if so desired. Further, the material composing the TRD can be solid, perforated, slotted, and so forth, while still providing a one-sided barrier against a user's finger to the CED's trigger.

The following description will be with respect to FIGS. 1-8, which are illustrations of an exemplary TRD from front" perspective, bottom "rear" perspective, left side, right side, front (slightly angled), rear (slightly angled), top and bottom views, respectively.

FIG. 1 illustrates one embodiment of an TRD 100 made in accordance with the present invention. TRD 100 includes a blocking member or access barrier 110, shown here as a planar piece. The TRD 100 further includes a bridging top member 120 joined to the blocking member 110, shown here at approximately 90 degrees. The TRD 100 further includes a non-blocking member 130 joined to the top member 120, shown here as also approximately 90 degrees. The combination forms an asymmetrical device.

The non-blocking member 130 in this exemplary embodiment is illustrated here with an angled end 135. The angled end 135 is optional. In this embodiment, the angled end 135 is disposed at an inward angle 150 from the non-blocking member 130, towards the blocking member 110. The inward angle 150 range within a value between 25 degrees to 80 degrees. In a commercial embodiment, the inward angle 150 was set at 45 degrees. In some embodiments, the angled end 135 may be curved or semi-continuously curved rather than straight. In some embodiments, the non-blocking member 130 may be multi-segmented, curved or tapered. Thus, the angled end 135 can appear as a natural extension of the non-blocking member 130. The non-blocking member 130 is operably sized and shaped so as fit over a top side of the CED and allow the TRD to "clip" onto the top area of the trigger well of the CED, thus securing it to the CED as will be shown below. Depending on the shape and sizing of the non-blocking member 130, the angled end 135 may be implemented to determine the degree of effort necessary to facilitate the attachment of the TRD to the CED.

Figure 3:
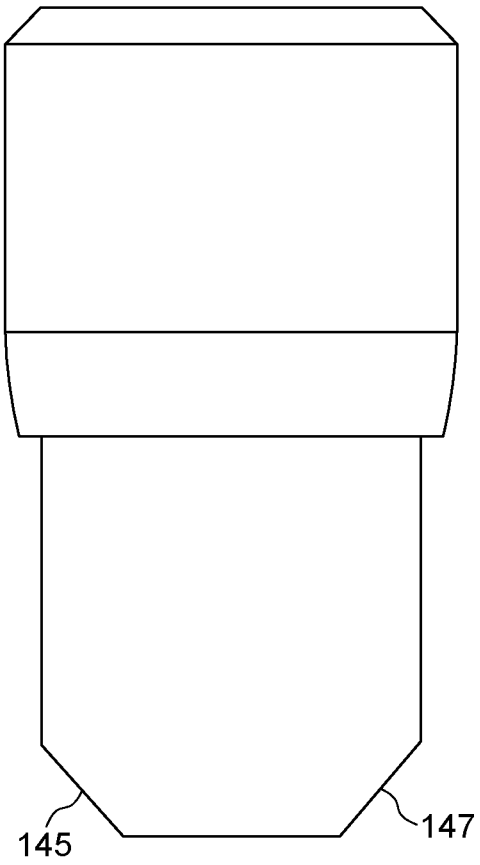
FIG. 3 is a left side view of the TRD of FIG. 1.
Figure 4:
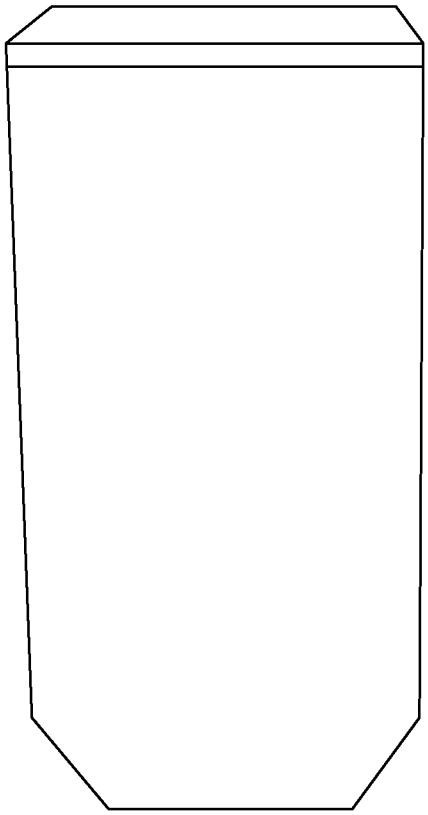
FIG. 4 is a right side view of the TRD of FIG. 1.
Figure 5:
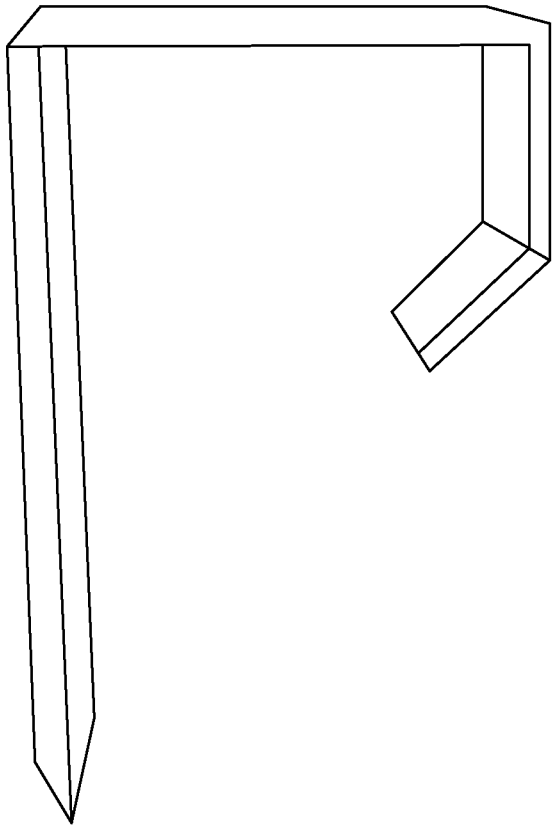
FIG. 5 is a front (slightly angled) view of the TRD of FIG. 1.
Figure 6:
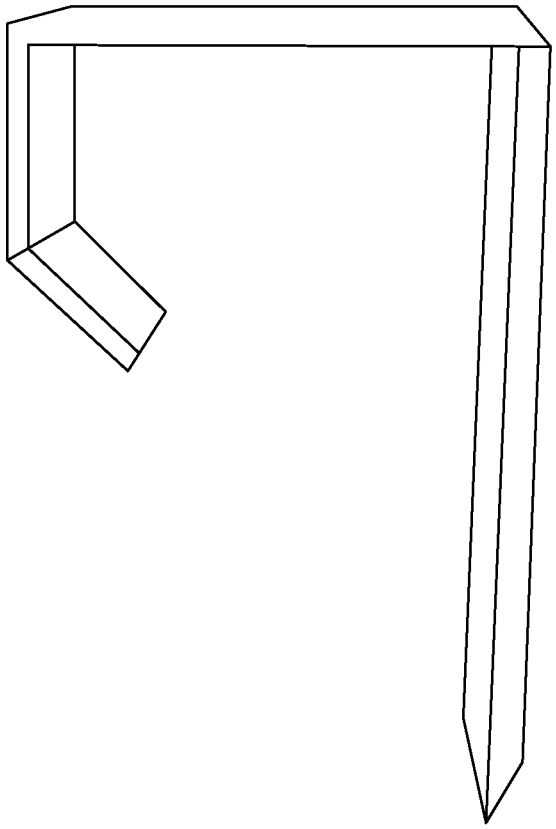
FIG. 6 is a rear (slightly angled) view of the TRD of FIG. 1.
Figure 7:
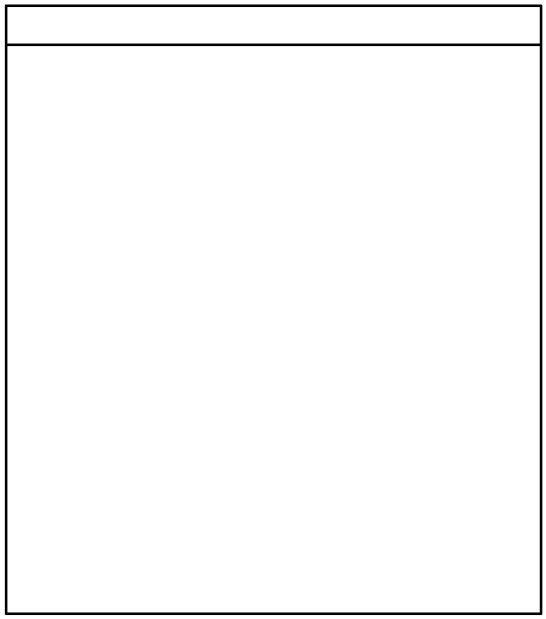
FIG. 7 is a top view of the TRD of FIG. 1.
Figure 8:
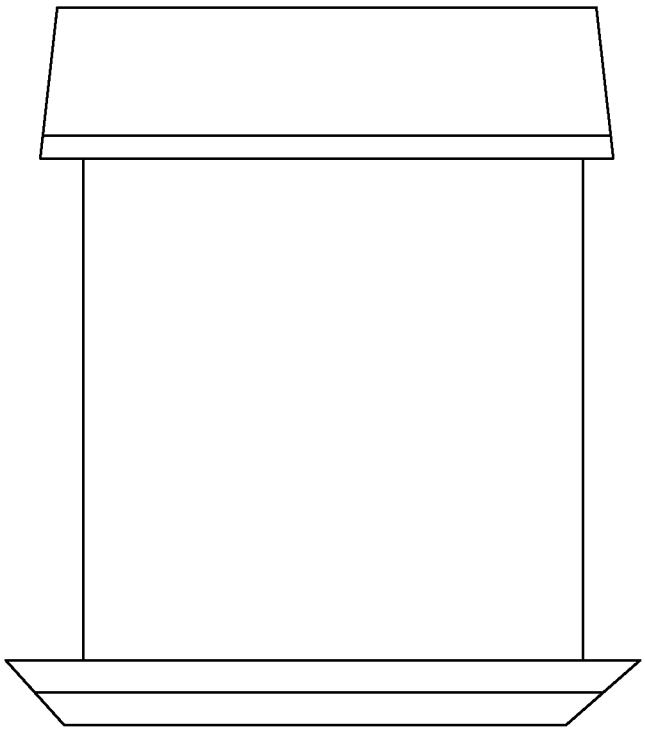
FIG. 8 is a bottom view of the TRD of FIG. 1.

One or more corners 145, 147 of the blocking member 110 or non-blocking member 130 can be tapered or trimmed to avoid sharp edges, as seen for example, in FIG. 3.

In various embodiments, the top member 120 can be designed to be long enough to fit across the top of the CED's barrel's section that is above the trigger well. In other embodiments, the top member 120 may be small enough to fit within and inside the top portion of the trigger well (instead of on top of the CED). It is understood that in various applications, the blocking member 110 can be as large as 1.5" in width and 2.5" in length, and the non-blocking member 130 with optional angled end 135 can be as large as 1.5" in width and 1.5" in length, as well as being formed from a single unitary piece of material, if so desired. Of course, other larger or smaller widths or lengths are possible, depending on the CED size, etc.

It should be appreciated that while the above FIGS. show a TRD with planar and segmented surfaces joined together at seemingly perpendicular angles, the top member 120 may or may not be planar or perpendicular to the respective blocking member 110 and non-blocking member 130, depending on design preference. For example, opposing sides of the TRD can be sized and appropriately angled so as to be "spring biased" to the CED when the TRD is fitted "over" the CED—thus securing the TRD to the CED.

Notwithstanding the above, it is expressly understood and appreciated that other TRD embodiments having different sizes, shapes, colors and materials can be devised and therefore are within the spirit and scope of this disclosure. Moreover, the exemplary TRD can be formed as a unitary one-piece device, from a single material, if so desired. Further, it will be appreciated that a TRD can be constructed as part of the CED.

Figure 9:
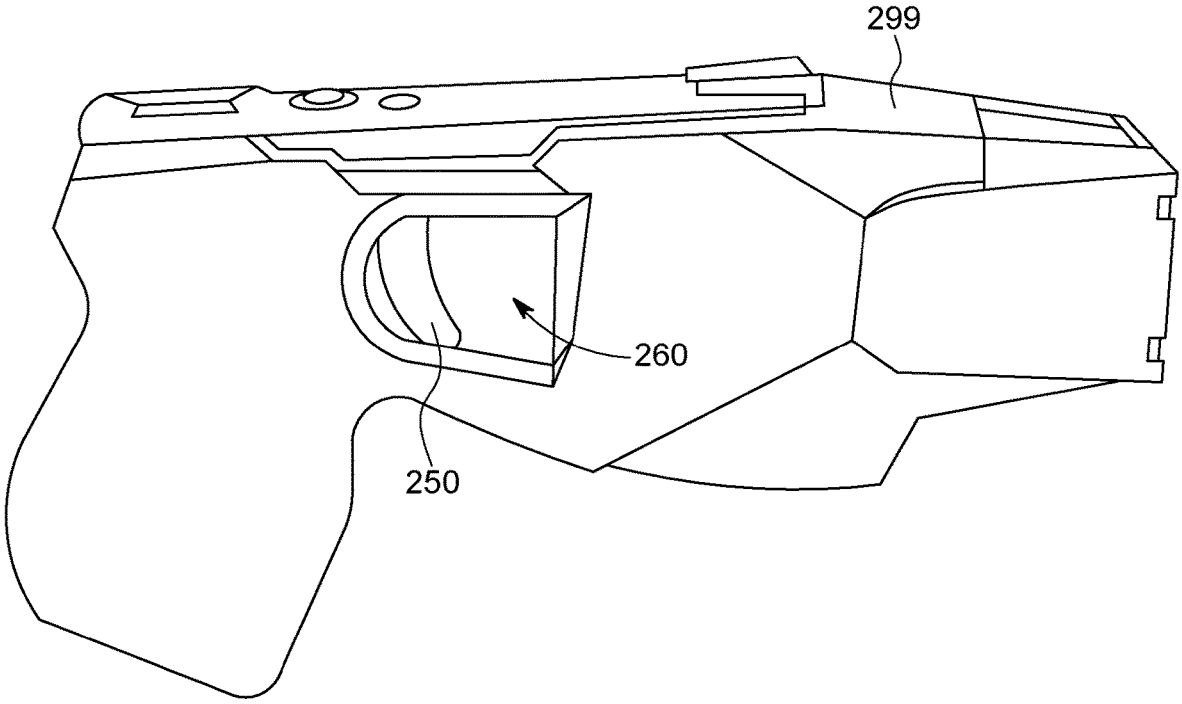
FIG. 9 is an illustrative example of a conducted energy device (CED) without a TRD.

FIG. 9 is an illustration of and representative of a commercially available CED 299 with an exposed trigger 250 within trigger well 260. For a person trained to use his lethal firearm with his dominant right hand and the CED 299 with his non-dominant or support hand (e.g., his left hand), an exemplary TRD would be attached to the CED 299 substantially covering CED's trigger well 260 to prevent entry of a dominant side, right-handed finger into the CED's trigger well 260. Thus, the CED 299 is rendered inoperable unless used with the left hand. Simply for reference purposes, a typical CED will range from 7-9" in length, with 4-5" of height and 1-3" in width.

For a left hand dominant person who is trained to shoot his lethal firearm with his left hand and the CED 299 with his non-dominant right hand, a left preventing or reversed positioned TRD would be installed on the opposite side of the CED 299, thus blocking the left hand side, if so desired.

Figure 10:
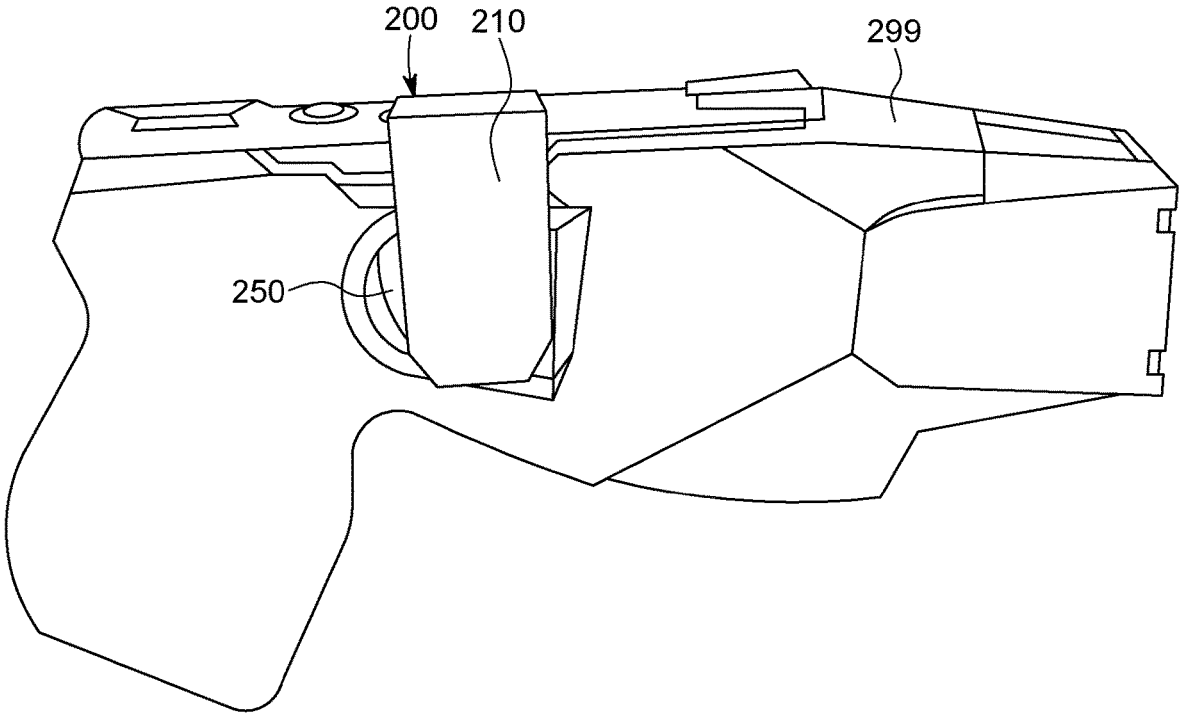
FIG. 10 is an illustration of an installed exemplary TRD for stopping right hand triggering of the CED.

FIG. 10 is an illustration of another exemplary TRD 200 installed on the CED 299 for preventing right hand operation. The TRD 200 is similar in function and some features to the TRD 100 above and includes similar features. A blocking member 210 substantially covers the right side of the trigger well (obscured from view) to prevent operation of the trigger 250.

As is apparent, the TRD obscures access to the trigger, depending on which side it is mounted on. Accordingly, a "universal" TRD (fittable on either side) can be rotated to be installed on the opposite side of the CED. Therefore, a universal TRD can be used for either left or right trigger prevention, based on which side it is mounted on.

The TRDs 100 and 200 are shown in a preferred embodiment having a typical size (but it will be appreciated that the size is variable according to design and CED model/type). For example, for fitment to Taser® Models: X26/X26P, Taser 2, and Taser, the TRD 100 of FIG. 1 was made with an overall width of approximately 1", the blocking member 110 length of approximately 1.875", the top member 120 approximately 1.5" long, non-blocking member 130 approximately 0.5" long with an optional terminal "inwardly" angled end 130 of approximate length 0.25".

FIGS. 11-19A-D are illustrations of aspects of another exemplary embodiment TRD 1200, made in accordance with the present invention. The TRD 1200 has a general L-like cross-sectional shape and is asymmetrical in shape. The TRD 1200 is complemented with a releasable strap 1250 operating as an attachment mechanism. FIG. 11 shows a bottom front perspective of TRD 1200 wherein blocking member 1210 is integrally joined to top member 1220.

Hook-loop fastening strap 1250 is shown with one end 1253 attached (removably) to the top member 1220 and the other end 1252 not yet attached to the blocking member 1210. It should be appreciated that the term hook-loop is in reference to a conventional removable attachment mechanism, commonly referred to in the industry as Velcro®, which is owned by Velcro IP Holdings LLC. And that hook-loop and loop-hook are interchangeable terms, noting either mates to the other. It is expressly understood that while a hook-loop fastener type means is described herein for attachment, other attachment means may be used. For example, an adhesive or adhesive tape, double sided adhesive tape, magnets, snaps, etc.

When installed onto CED, the bottom end 1252 of the fastening strap 1250 is secured to slots (not shown in this figure) in blocking member 1210 and the top end 1253 is releasably attached to the TRD's 1200 top member 1220, the top member 1220 having a mating hook-loop fastener section (not shown) for fastening strap 1250 attachment. To assist in the securing of the fastening strap 1250 to the blocking member 1210, a hook-fastener contact section 1215 can be disposed on the bottom interior side of blocking member 1210. Thus, an operator of the TRD can release the TRD from the CED by pulling the fastening strap 1250 from/off the top member 1220 (noting both contain appropriate hooks-loops), or loosening the bottom of the fastening strap 1250 from the blocking member 1210's contact section 1215. Optional alternative contact section locations 1215A, 1215B, 1215C, 1215D on the blocking member 1210 are shown in dashed lines. It will be appreciated that other contact locations could be located at other locations in other various exemplary embodiments.

Figure 12:
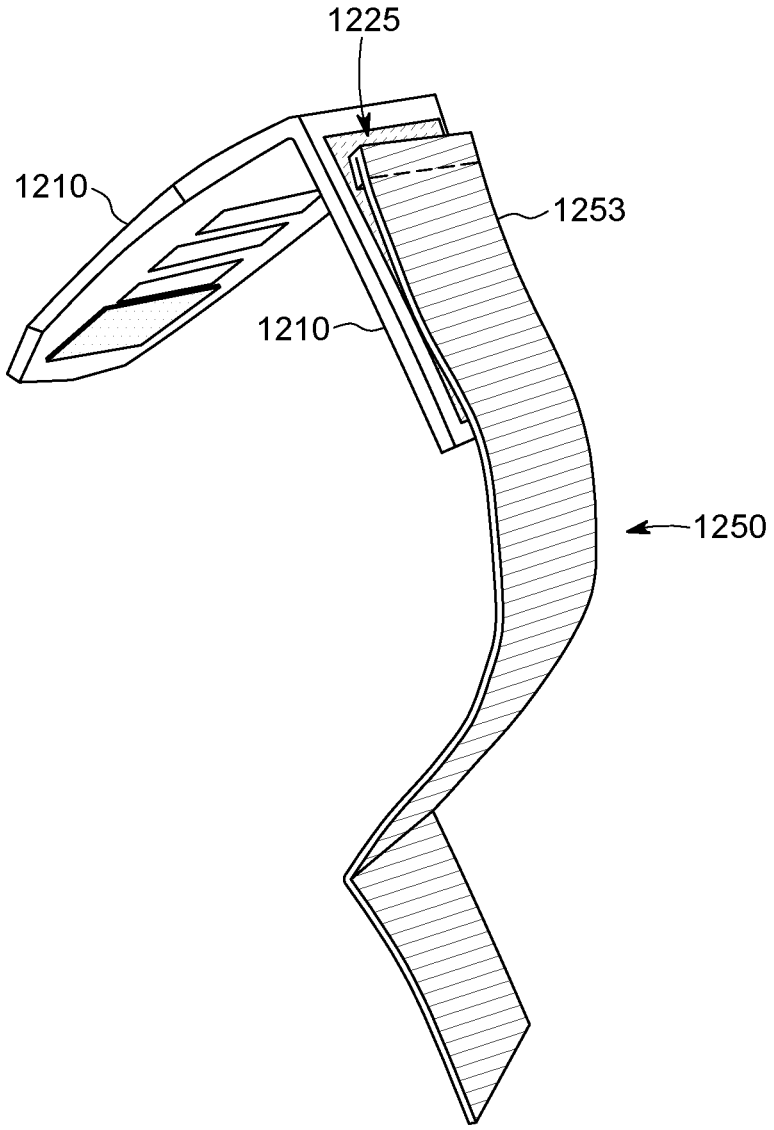
FIG. 12 shows a top perspective view of the TRD of FIG. 11.

FIG. 12 is a top front perspective view of the TRD 1200 of FIG. 11 in an unfastened state. Top end 1253 of the fastening strap 1250 is releasable attached to top member 1220 via a mating hook-loop section 1225 of top member 1220. When in the unfastened state, the TRD 1200 is not affixed to a CED.

Figure 13:
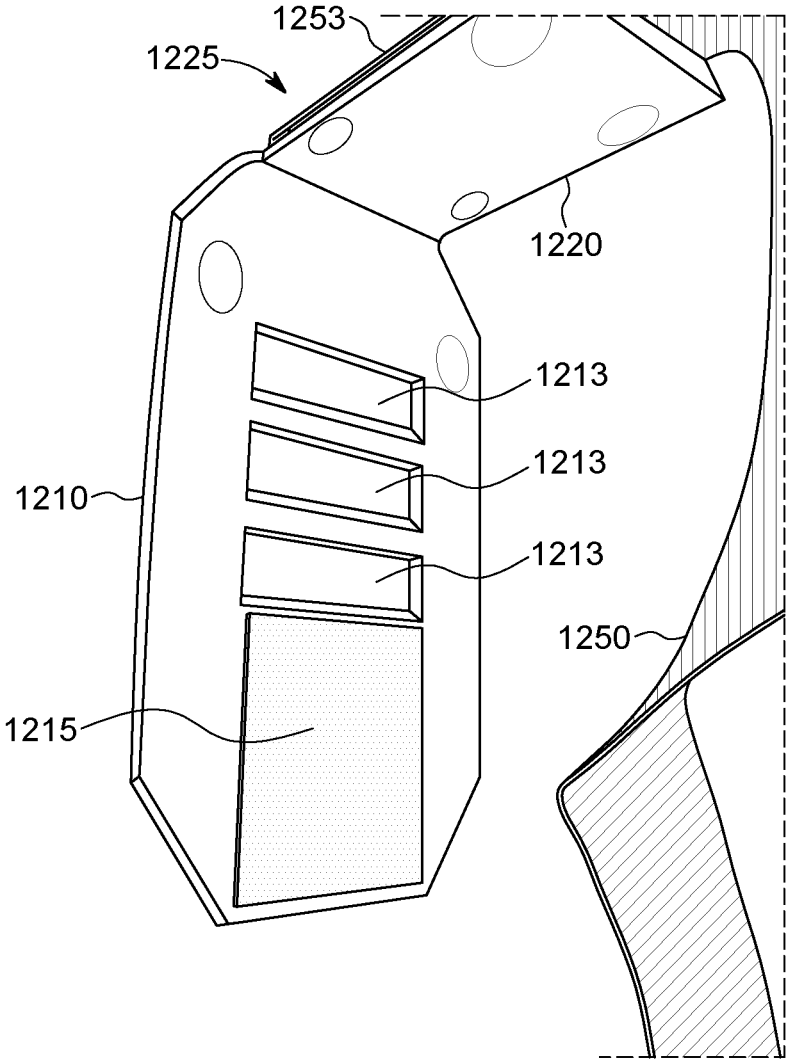
FIG. 13 shows a closeup view of the TRD of FIG. 11 with openings or slots for receiving and threading of a fastening strap.

FIG. 13 shows a bottom front closeup view of the TRD of FIG. 11 with one or openings or slots 1213 within blocking member 1210 used for insertion of and securing of the bottom end of the fastening strap 1250. The "securing" can be formed by wrapping the bottom of the fastening strap 1250 through the one or more slots 1213 and then looping the top end 1253 of the fastening strap 1250 around/through the CED's trigger well to be removably attached (hook-loop) to the top member's mating hook-loop section 1225. The TRD 1200 can be freed from the CED by loosening or pulling the top end 1253 or bottom end of the fastening strap 1250. The choice of slot size, shape and number thereof is of a design choice. For example, with multiple slots the fastening strap 1250 can be secured to whichever slot provides the appropriate fitment "length" for the fastening strap 1250, noting different CED's will have different thicknesses that the fastening strap 1250 must fit over.

In a commercial embodiment, the bottom portion of the blocking member 1210 also contained a hook-loop contact section 1215, wherein a mating hook-loop section (not shown) on "lower" end of the fastening strap 1250 is attached to the blocking member's contact section 1215. This approach allows for easy "attachment" and "removal" of both ends of the fastening strap 1250 (to the blocking member 1210 and top member 1220).

Figure 14:
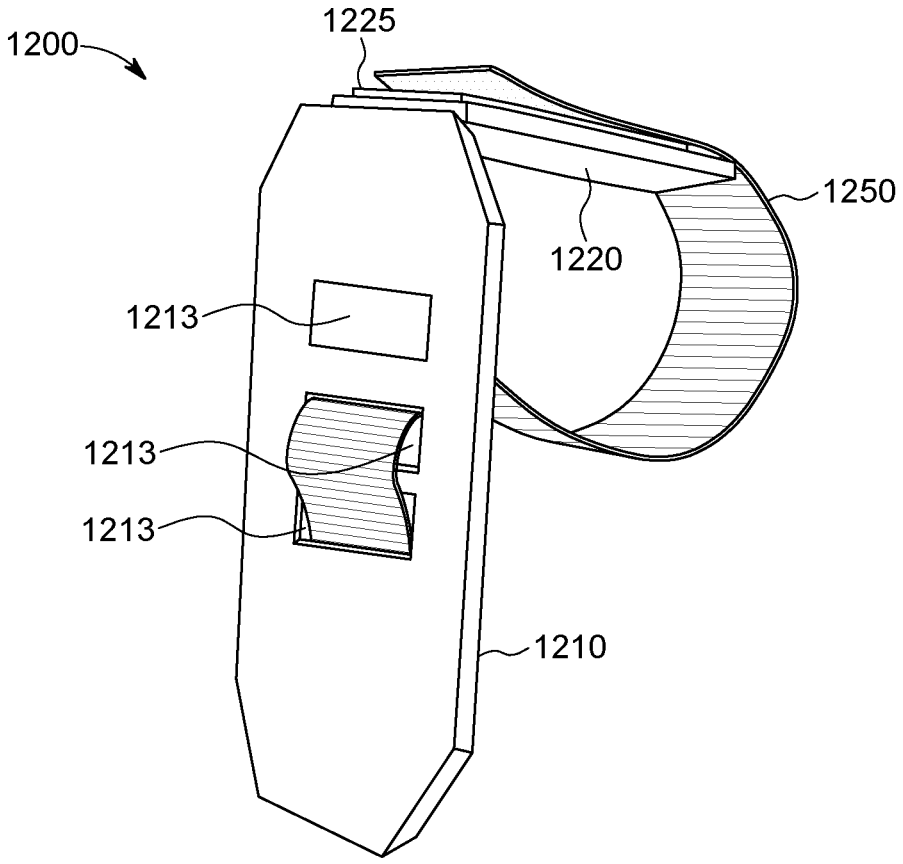
FIG. 14 is an outer side perspective view of the TRD of FIG. 11 with the fastening member in a secured position.

FIG. 14 is a right front "external" (outside) perspective view of the TRD 1200 with the strap 1250 in a fastened state. Generally the TRD 1200 will be in the fastened state when the TRD 1200 is in use on a CED, not shown in this FIG. The strap 1250 is shown attached to both the blocking member 1210 and the top member's 1220 hook-loop section 1225, as detailed in FIG. 13. Of course, the number of, shape and selection of slots 1213 used may vary, according to implementation preference. As is apparent, to allow for alignment of the fastening strap 1250 to the top member's hook-loop section 1225, the positioning of the bottom end of the fastening strap 1250 in slots 1213 can be adjusted. It is understood in some embodiments that, like the blocking member's slots 1213, the top member 1220 may also have slots therein (instead of or in addition to the top member hook-loop section 1225) for securing the top of the strap 1250. Further by using alternative contact section locations as contemplated above, it will be appreciated that the fastening strap 1250 could in other various exemplary embodiments go through only one slot 1213 and then reattach to the blocking member 1210, when in the fastened state.

Figure 15:
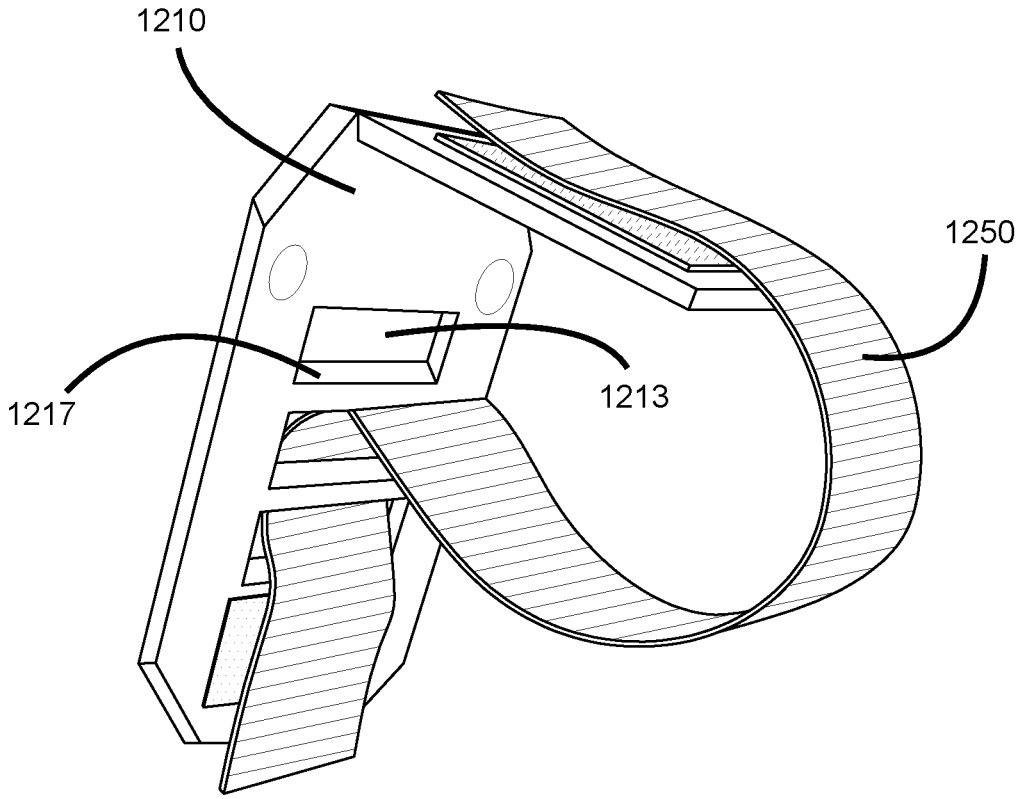
FIG. 15 is an inner side perspective view of the TRD of FIG. 11 with the fastening member in a secured position.

FIG. 15 is a left front perspective "internal" (inside) view of embodiment shown in FIG. 15 and shows the TRD in the fastened state, and is understood to be self-explanatory. Optionally shown are chamfered sides 1217 adjacent to the slots 1213.

Figure 16:
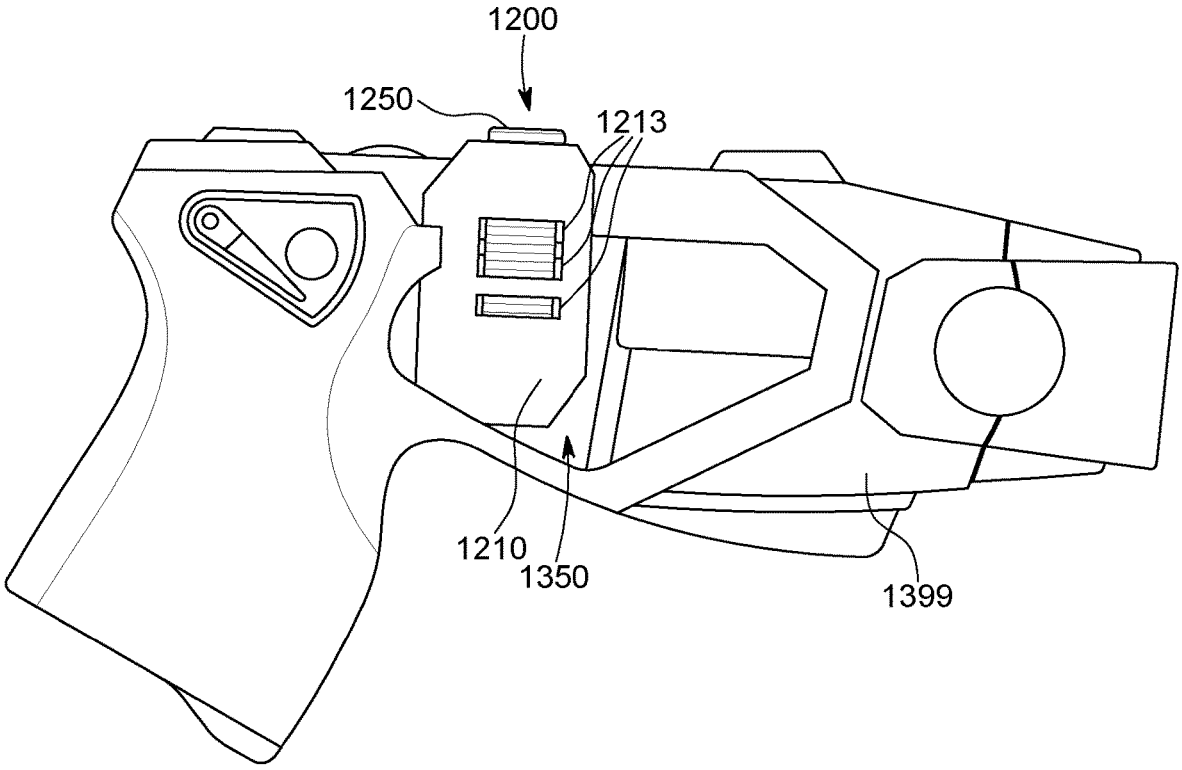
FIG. 16 is a view of the TRD of FIG. 11 installed on a CED illustrating how a trigger well of the CED is substantially blocked by the TRD.

FIG. 16 is a view of the TRD 1200 installed on a CED 1399, blocking a right hand triggering of the CED 1399. Here, the fastening strap 1250 is secured to the blocking member 1210 via looping through the slots 1213 (and hook-loop attached to a hook-loop contact section—obscured from view) and then fed through the trigger well 1350 onto and releasably hook-loop secured to the top member (not shown). As is apparent, the trigger of the CED 1399 is blocked from access by the blocking member 1210 size and shape which substantially covers the CED's trigger well 1350.

Figure 17:
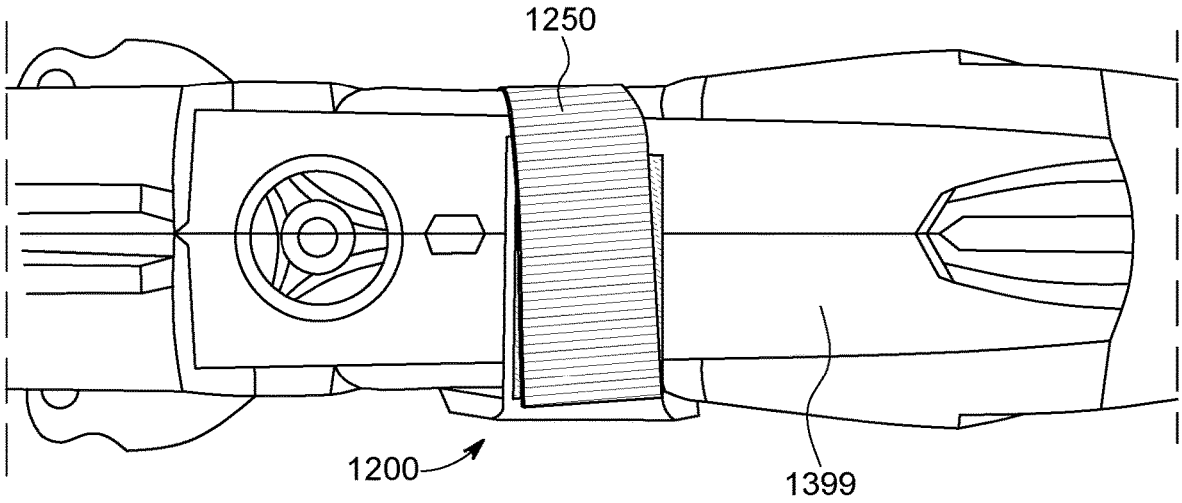
FIG. 17 is a top view of the TRD of FIG. 11 shown installed on a CED.

FIG. 17 is a top view of the TRD 1200 installed on the CED 1399, via the fastening strap 1250. As is readily apparent, the form factor of the TRD 1200 is minimal and such that it does not protrude out from the CED 1399. Thus, a TRD'ed CED will easily fit within a holster and also be easily removed, without interference from the TRD.

Figure 18:
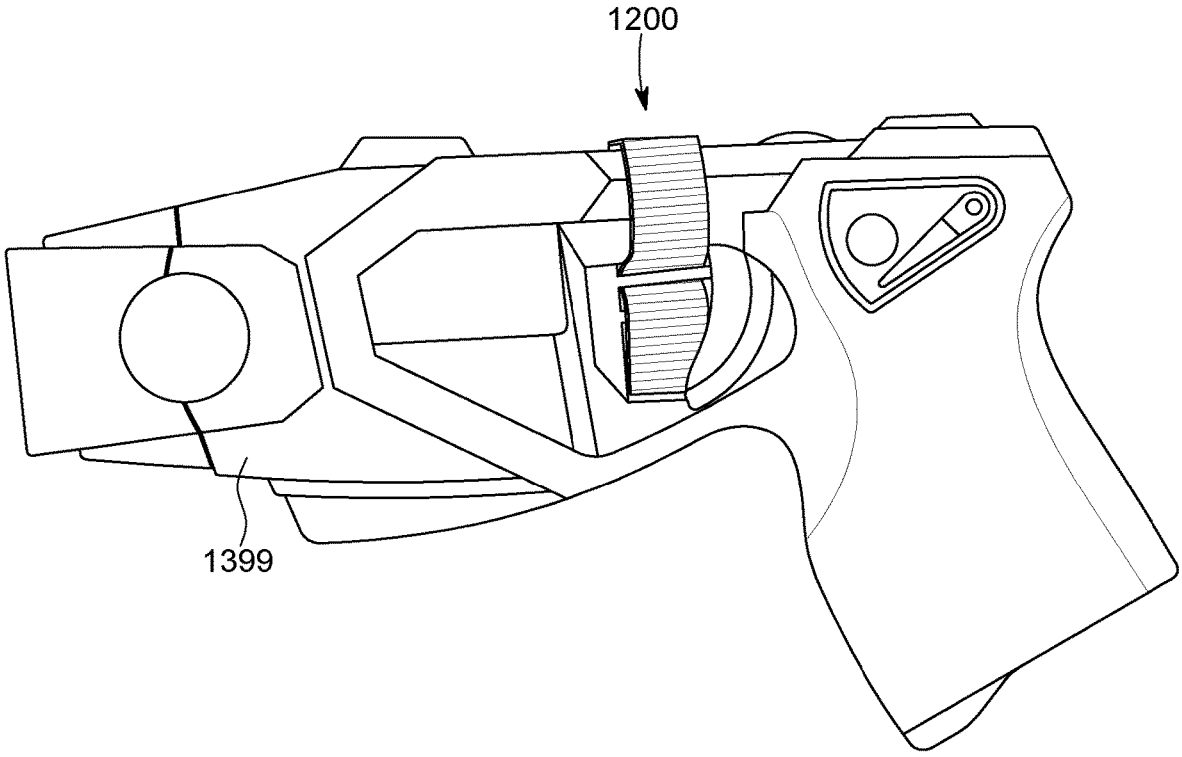
FIG. 18 is an opposite side perspective of the TRD of FIG. 11 shown installed on a CED illustrating how the trigger well is accessible.

FIG. 18 is an access side view of the TRD 1200 installed on the CED 1399 and is understood to be self-explanatory. The TRD 1200 when installed is operably configured to allow access to the support side trigger well so that the user can train with the CED to build muscle memory to only use the CED with the support hand. Here, we can see the trigger 1355 exposed and usable for left-hand use.

Figure 19A:
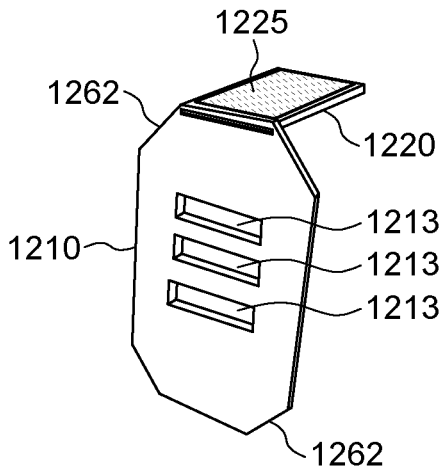
FIG. 19A is an outer side view of the TRD of FIG. 11, without a fastening member.

FIGS. 19A-D show various elements for the exemplary TRD shown in FIG. 11 in a commercial embodiment, noting these shapes, elements, arrangements may vary depending on design preference. FIG. 19A shows an outside view of an exemplary TRD's blocking member 1210 having slots 1213 arranged in parallel and joined to top member 1220. In the commercial embodiment, the slots 1213 were approximately 0.515" wide and 0.125" high, being separated parallel from each other by approximately 0.125". The height of the blocking member 1210 was approximately 1.811" while its width approximately 1". In the commercial embodiment, a thickness of the sections was approximately 0.078". The tapering of one or more corners 1262 of the blocking member 1210 are optional. Top member 1220 was sized to be approximately 0.5" wide and 1" in length. Top member 1220 was formed as integral to the blocking member 1210, forming an "L-like" shape. On the top of top member 1220 is a hook-loop contact section mating hook-loop section 1225 for attachment to fastening strap 1250.

Figure 19B:
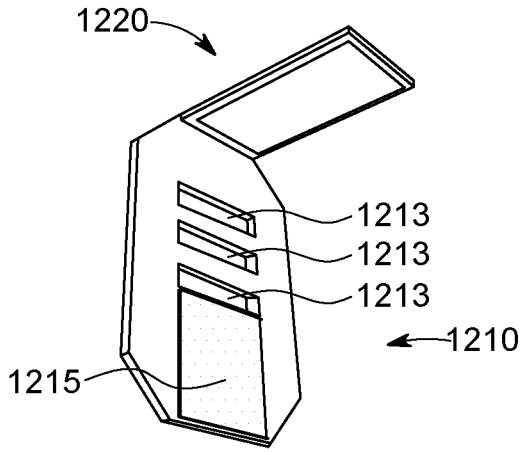
FIG. 19B is an inner side view of the TRD of FIG. 11, without a fastening member.

FIG. 19B is an interior view of an exemplary TRD's top member 1220 joined to blocking member 1210 having slots 1213. Visible is blocking member 1210's contact section 1215 at the interior bottom portion of the blocking member 1210. In some embodiments, the contact section 1215 may be situated at a different portion of the blocking member 1210, for example at a top portion, or even on an opposite side (external). Thus, various changes and modifications can be made without departing from the spirit and scope of this disclosure.

Figure 19C:
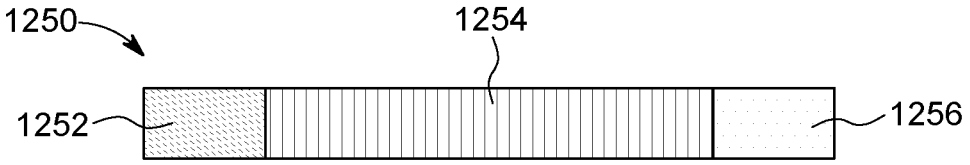
FIG. 19C is an illustration of a bottom side of a fastening member.

FIG. 19C shows a commercial attachment mechanism for this TRD embodiment, shown here as a fastening strap 1250. The commercial embodiment's fastening strap 1250 can be approximately 0.5" in width while approximately 4" in length, having a center section 1254 with hook-loop fitted ends 1252, 1253.

Figure 19D:
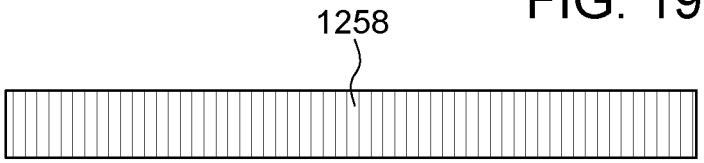
FIG. 19D is an illustration top side of the fastening member.

FIG. 19D is a top side of the fastening member 1250. In some embodiments, the opposite side 1258 of the strap 1250 may not have any hook or loop mechanism.

Figure 20:
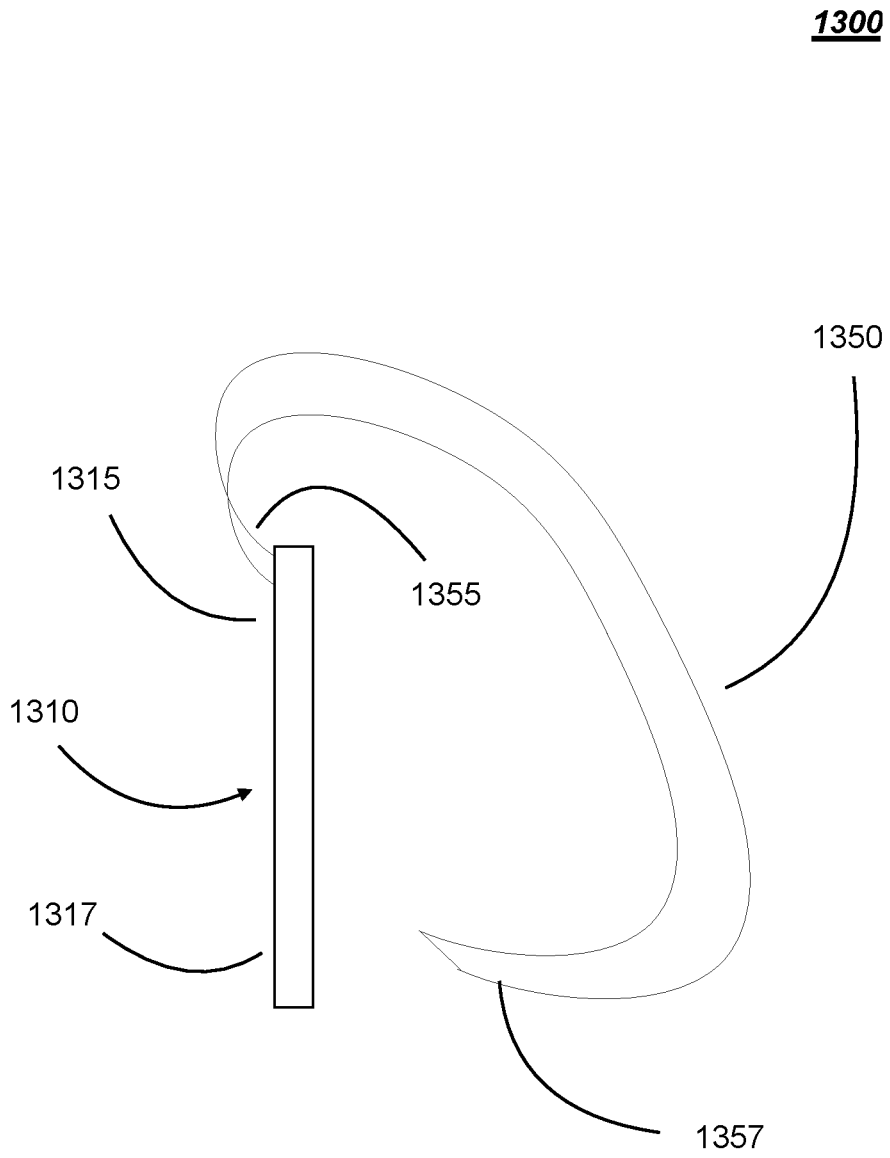
FIG. 20 is a side view illustration of another TRD embodiment using only a blocking member and non-blocking member.

FIG. 20 is a side view illustration of another TRD embodiment 1300 using only a blocking member 1310 and non-blocking member 1350. This example shows an embodiment where the need for an identified "top member" is obviated by attachment of ends 1355, 1357 of non-blocking member 1350 to the "top" 1315 and "bottom" 1317, respectively, of the blocking member 1310. As shown here, the non-blocking member 1350 may be a flexible strap or similar like object. Also, the blocking member 1310 can have any of the features found in the previous embodiments and their blocking members. Attachment of the non-blocking member 1350 to the blocking member 1310 can be through any of the mechanisms and methods described in the above FIGS. Additionally, in some embodiments, the TRD 1300 may be made of a single piece of material or unitary in form. Also, one end of the non-blocking member 1330 may be permanently attached or integrated with the blocking member 1310.

While the above immediate embodiments utilize a loop-hook fastener strap, it is understood that other forms of releasably "latching" together may be used. Further, while the "hook-fastener" strap is fastened via a slot to the blocking member, in some embodiments the strap may be secured via other means, either temporarily or permanently. Since the concept of tying or affixing a strap (containing hooks/loops) to an object and to itself is well known in the art, other suitable "attachment" schemes are understood to be within the purview of this disclosure. As non-limiting examples, one of the "ends" of the fastening strap may be permanently attached to the TRD with the other end free for releasable attachment, or a buckle like device may be used to tighten the TRD-attached strap to a CED. Also, in some other embodiments, the TRD itself could be removably or permanently attached to the CED via an adhesive or tape, thereby negating the requirement for a fastening strap. In some embodiments, the top member (or a portion thereof) of the TRD can be made of a material that stretches and can be wrapped over/through the CED trigger well to be secured to (or through) the blocking member. Or the fastening strap is elastic and via a cut or opening in the strap can be "hooked" onto the blocking member and/or top member. In other embodiments, the top member may be of a very short length, providing only enough structural restraint to prevent the blocking member from being displaced from the CED's trigger well, when attached thereto. Also, a top portion of the blocking member could fold over, so as to proxy a function of the top member. Further, various top member attachment schemes may be used that are different than the one(s) shown herein. For example, a snap mechanism could be utilized, or the top member may also have a hook, one or more slots for strap retention, etc. Also, in other embodiments, the blocking member may not be plate-like nor substantially rectangular in shape.

Moreover, not illustrated but possible is the dispensing of the top member from the design, wherein the attachment strap or attachment means can connect from the "bottom" of the blocking member (or an interior side) and loop around the top of the CED's trigger well, and attach to the other side of the blocking member, thus similarly operating secure the restriction device to one side of the trigger well.

Figure 21:
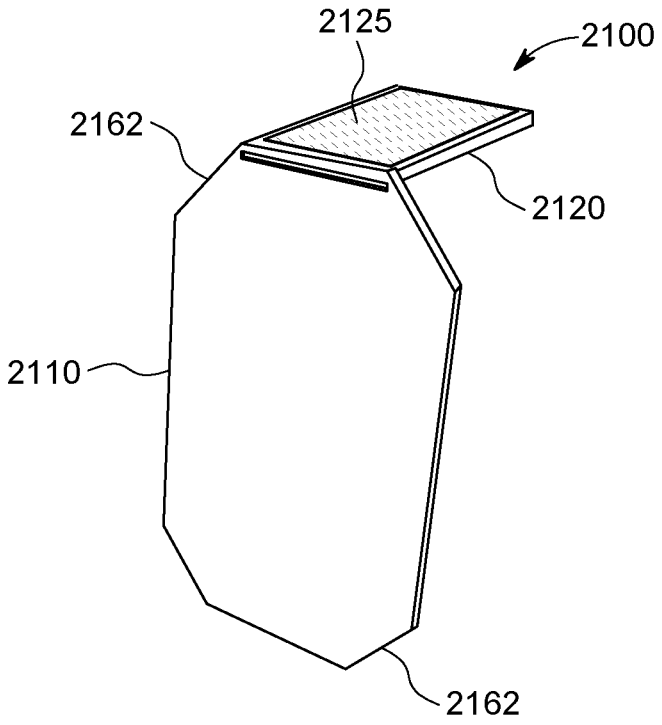
FIG. 21 shows a view of another exemplary TRD embodiment using an attachment member with a fastener section.

FIG. 21 shows a view of another exemplary TRD's embodiment 2100 with a solid blocking member 2110 joined to a top member 2120. On the top of top member 2120 is a fastener section 2125. The fastener section 2125 serves as a means for attachment to an inside of a CED's trigger well (not shown) via placement of the top member 2120's fastener side therein. The means of attachment is seen via the fastener section 2125 which is on the outer side of the top member 2120 and is on the same "outer" side of the blocking member 2210. The fastener section 2125 may be magnetic-based and/or adhesive-based for adhesion to a CED. For example, in some implementations, if the CED is metal, it may be desirable (but not necessary) to utilize a magnetic means for attachment to the CED. In various implementations, it may be desirable instead to utilize an adhesive means, for example an adhesive strip, or double-sided adhesive tape, or a foam-backed adhesive tape, and so forth. The use of a magnetic or adhesive fastener section 2125 allows the TRD 2100 to be secured to a CED without the need for a fastening strap. Fastener section 2125 can be in a single one-piece shape, as shown, or be composed of several pieces, of different shape, etc., depending on implementation preference. The illustrated tapering of one or more corners 2162 of the blocking member 2110 are optional but smooth the transition from the larger width of the TRD's guarding side (blocking member 2110) to the top member 2120. Top member 2120 is formed as integral to the blocking member 2110, so as to be a one-piece device having a near perpendicular "L-like" shape, the blocking member 2110 typically being longer and larger than the top member 2120, due to the dimensions of a trigger well (not shown).

It should be appreciated that the blocking member 2110, attachment member 2120 and the fastener section 2125 shapes may be altered from what is shown. For simplicity sake, this and the following examples show a rectangular form of the fastener section 2125 but other forms may be implemented, if so desired. Further, while the embodiments display "members" being substantially planar in form, it is not necessary, being the simplest form to use. Curved, domed, bubbled, pocketed, and other variations including those described previously can be used, without departing from the spirit and scope of this disclosure. For example, depending on the CED's trigger well's shape, the fastener member may be rounded, or curved to better attach thereto.

Figure 22A:
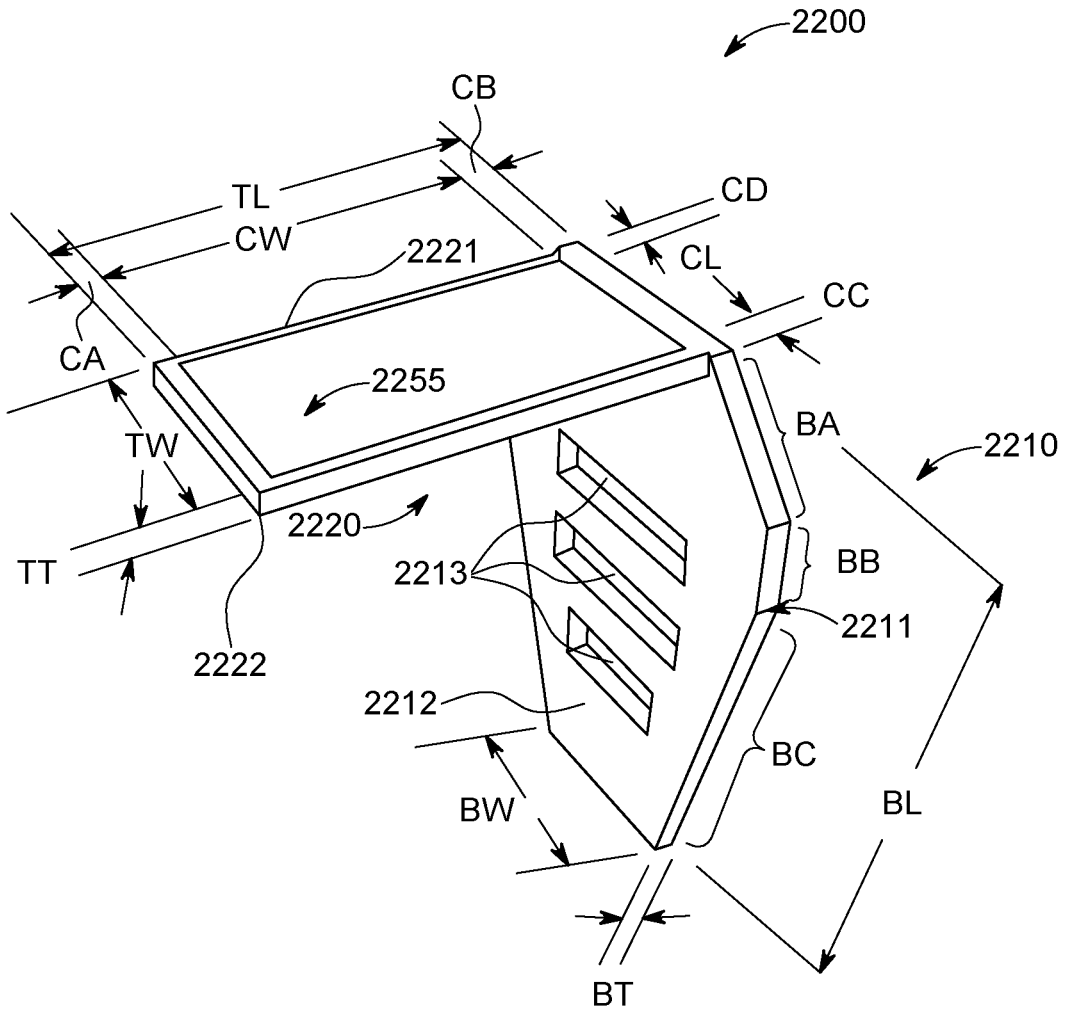
FIG. 22A is a top perspective view of another exemplary TRD embodiment with an attachment member with a fastener section.

FIG. 22A shows a view of another exemplary TRD embodiment 2200 using a blocking member 2210 with an attachment member 2220. The attachment member 2220 may also be referred to as a top member or non-blocking member or upper arm herein. The blocking member 2210 may also be referred to as a blocking arm, and has an outer surface 2211 (obscured from view) and an opposing inner surface 2212. The blocking member 2210, in this embodiment, includes at least one opening 2213. The opening 2213 extends from the outer surface 2211 through to inner surface 2212. In this illustrated embodiment, there are a plurality of openings 2213. The openings 2213 in this embodiment are shown as slots. It will be appreciated that other shapes may be utilized for the openings 2213. Further it will be appreciated that the openings 2213 are optional and may be completely omitted.

The attachment member 2220 has an outer surface 2221 and an opposing inner surface 2222 (obscured from view). As evident, the outer surface 2221 is contiguous with and flowing into the outer surface 2211 of the blocking member 2210, both surfaces sharing a common "outer orientation" of their sides, being integrally formed and fixed in shape. The attachment member 2220 has a generally rectangular shape as shown. The attachment member 2220 in this embodiment is generally planar in shape. The attachment member 2220 has a width TW and a length TL. The attachment member 2220 also has a thickness TT.

The TRD 2200 further includes a fastener 2225 disposed on the outer surface 2221 of the attachment member 2220. The outer surface 2221 is operably configured to engage a CED when the TRD 2220 is in use. Particularly the fastener 2225 is operably configured to attach to the CED when the TRD is in use. In some other exemplary embodiments, the TRD is removably attachable to a CED.

In this particular embodiment, the fastener 2225 is an adhesive. The fastener 2225 is as a means for attachment to a CED (not shown). The fastener 2225 may be an adhesive strip, double-sided adhesive tape, a foam-backed adhesive tape, and so forth. The use of a fastener 2225 enables the TRD 2200 to be secured to a CED without the need for a fastening strap as detailed herein for other embodiments. The fastener 2225 in this embodiment is made of one single piece of material, as shown. It will be appreciated that in other exemplary embodiments the fastener could be made from multiple pieces, depending on implementation preference. This illustrated embodiment replicates a commercial embodiment utilizing an adhesive-based fastener 2225. The adhesive-based fastener 2225 was a strip of double-sided adhesive tape manufactured by 3M and corresponded to VHB Acrylic Double-Sided, having dimensions of approximately 0.5"×0.75" and 0.020" in thickness.

The blocking member 2210 has a generally rectangular shape as shown here additionally with chamfered sides. The blocking member 2210 in this embodiment is generally planar in shape. The blocking member 2210 has a bottom width BW and a length BL. The blocking member 2220 also has a thickness BT. The bottom width BW of the blocking member 2210 can be greater than the width TW of the attachment member 2220, as shown here. The largest width (not visible) of the blocking member 2210 can also be larger than the width TW of the attachment member 2220. It will be appreciated that the respective widths in other embodiments can be designed at such a dimension so as to match to a degree of performance, the CED that it is to be used upon. For example, in alternate designs, it may be desirable to have the width TW of the attachment member greater than the width of the blocking member. This would enable a greater contact/adhesion surface. Such design choices are understood to be within the purview of this disclosure, and not limited to the exact features shown in the illustrated embodiments.

Lateral sides BA, BB, BC of the blocking member 2210 can be angled, tapered, chamfered, or altered relative to a standard rectangle shape. It will be appreciated that a non-rectangular shape is optional. Having the chamfered lateral sides BA, BB, BC for the blocking member 2210 enables a smooth transition from the larger width of the blocking member 2210 to the narrower attachment member 2220. In this embodiment, the attachment member 2220 is formed as integral with the blocking member 2210. In this embodiment the attachment member 2220 and the blocking member 2210 together are a one-piece device, preferably but not necessarily of a single material type.

It should be appreciated that while a rectangular-like shape is the general form used, it is understood that other shapes for the blocking member 2210, attachment member 2220 and the fastener 2225 may be utilized. For simplicity, this and the following examples show a rectangular form of the fastener 2225 but other forms may be implemented, if so desired. Further, while the embodiments display "members" being substantially planar in form, it is not necessary in all embodiments. Curved, domed, bubbled, pocketed, and other variations including those described previously can be used, without departing from the spirit and scope of this disclosure. For example, depending on the shape of a trigger well of a CED, the non-blocking member may be rounded, or curved to better attach thereto. Similarly, it will be appreciated that the blocking member in other implementations may take on an entirely different shape sufficient to block the trigger well of a CED.

In the commercial embodiment, a design that proved to be not too large or not too small so as to fit the CED's that were tested and provided adequate trigger blockage had an attachment member 2220 width TW of approximately 0.5625", a length TL of approximately 0.9375", and a thickness TT of approximately 0.040"-0.059" depending on the substrate/material type used. The tape on the adhesive-based attachment member 2225 was sized, to cover the majority of the attachment member 2220, having a width CW of approximately 0.5" and a length CL of approximately 0.75".) Arbitrary separations from the ends of the attachment member 2220 are annotated as CA, CB, CC, and CD ranged approximately between 0.030" to 0.035". The blocking member 2210 was a length BL of approximately 1.3125", a thickness BT of approximately 0.040"-0.059" according to material used, and a bottom width BW of approximately 0.5". The commercial embodiment included three openings 2213 as shown. Of course, in other embodiments, the dimensions, sizes, shapes, angles, openings, if any, may be different than in the commercial embodiment.

Figure 22B:
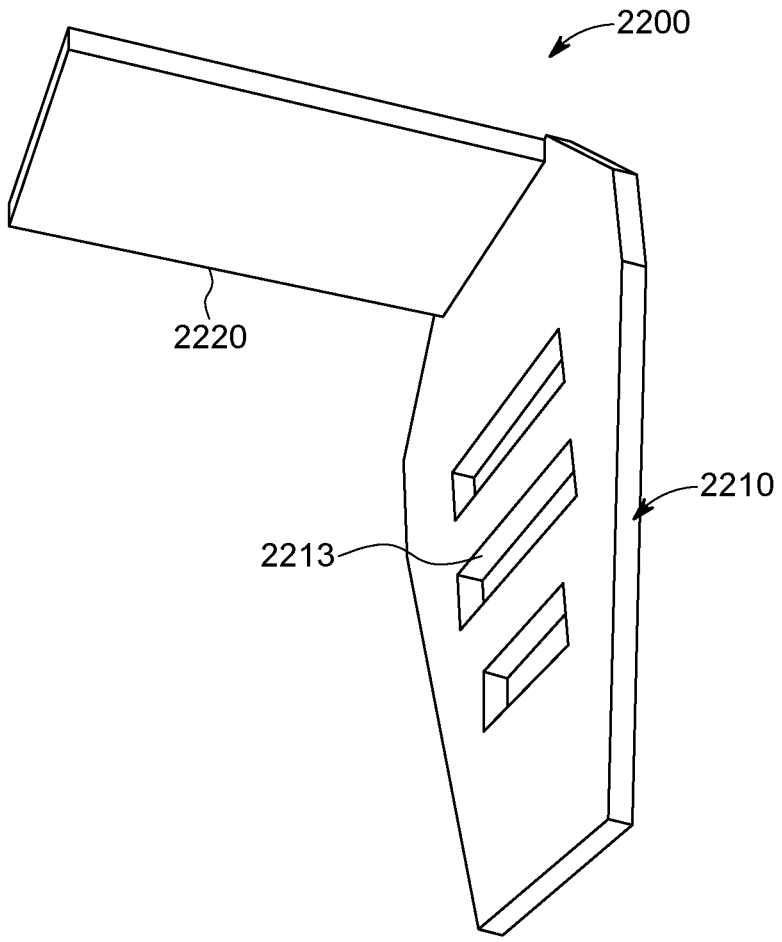
FIG. 22B is an interior view of the embodiment of FIG. 22A.

FIG. 22B is an interior view of the TRD embodiment 2200 of FIG. 22A, with a blocking member 2210 with one or more openings 2213, and coupled to the attachment member 2220 with fastener (not shown) on the outer side of the attachment member 2220. This view shows the openings 2213 into the interior of the TRD 2200.

Figure 22C:
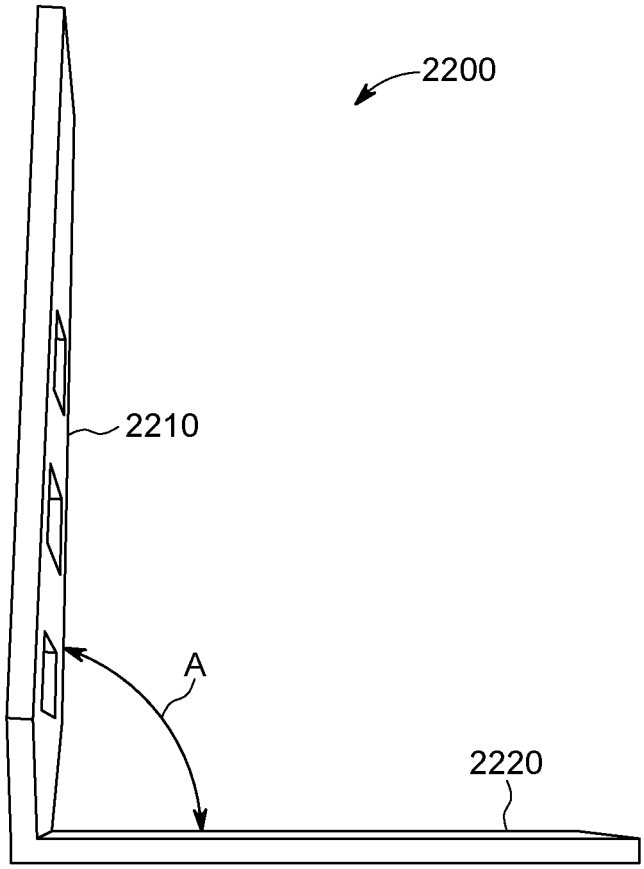
FIG. 22C is a slightly off-axis side profile view of the embodiment of FIG. 22A.

FIG. 22C is a slightly off-axis side profile view of the embodiment 2200 of FIG. 22A showing the near perpendicular arrangement of the blocking member 2210 to the attachment member 2220. The slightly off-axis orientation obscures, in this view, the adhesive contact section (fastener). The angle between the blocking member 2210 to the attachment member 2220 is represented as "A" and while appearing to be approximately 90 degrees, it is understood that depending on CED's trigger well's configuration, or design consideration, the degree angle "A" may be altered. For example, in a CED with a trigger well surface being curved or off-angled, the TRD angle "A" may be altered (reduced or increased) to allow the blocking member 2210 to be as flush as desired (or within) the trigger well. The ability to be nearly or "flush" (or within) the trigger well prevents the TRD from protruding from the CED and interfering with the holster when unholstering the CED for use.

Figure 23:
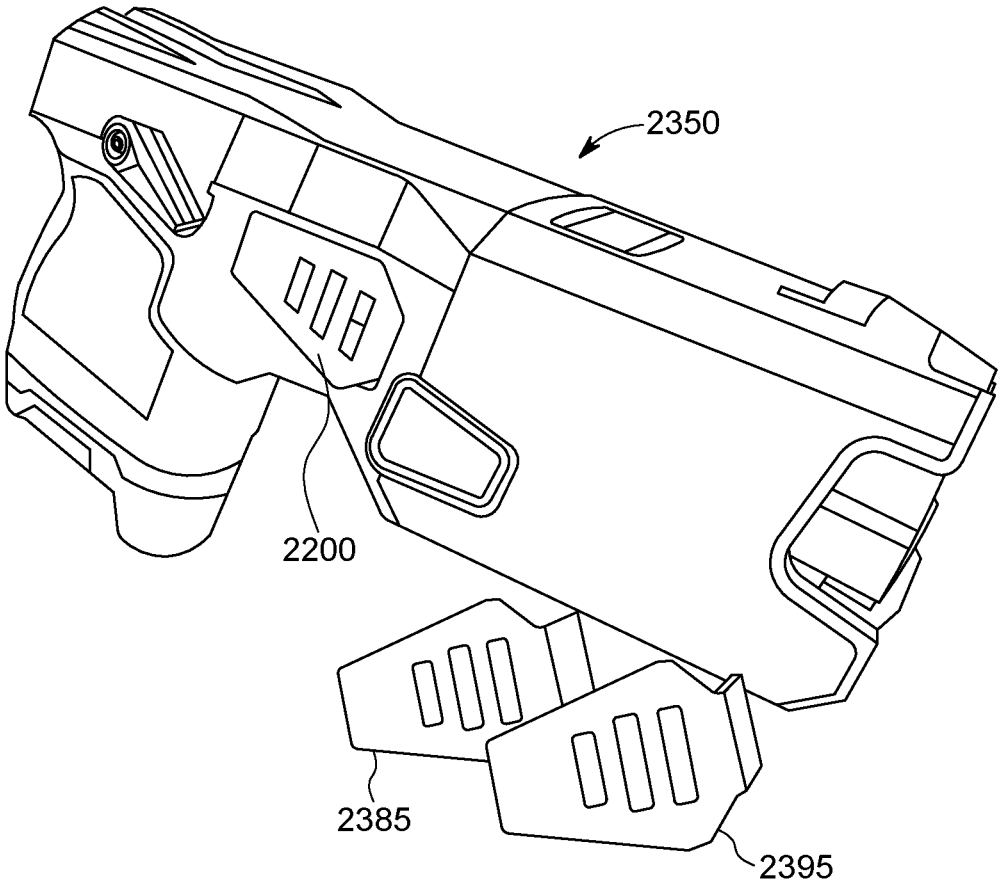
FIG. 23 is an illustration of a CED with an exemplary TRD installed therein and two other non-installed TRDs.

FIG. 23 is an illustration of a CED 2350 of the TRD 2200 of FIGS. 22A-C installed in the CED's trigger well (obscured from view by the TRD 2200). The size of the TRD 2200 is large enough to cover the entire trigger well. Also illustrated are two other non-installed TRDs 2385, 2395 with slightly different sizes to demonstrate the size variability to potentially "match" CEDs having different trigger well sizes.

The attachment member (obscured from view) of the TRD 2220 is affixed to the interior of the trigger well. The TRD 2200 includes a fastener (obscured from view), and the fastener attaches the TRD 2220 to the CED 2350. In this embodiment the fastener is a double-sided adhesive tape. To install the TRD 2220 to the CED 2350, a backing of the tape is removed and the TRD attachment member is inserted into the trigger well of the CED 2350 and firmly pressed to the trigger well to affix the TRD 2220 to the CED 2350. It should be appreciated that the TRD 2220 is affixed such that the blocking member substantially obstructs a desired side of the trigger well. In other words, after the TRD 2200 is affixed, a user of the CED 2350 will not be able to insert their finger into the trigger well from the obstructed side. It will be appreciated that in other exemplary embodiments, the attachment member is affixed to the top of the trigger well rather than a side as shown. Further, it will be appreciated that the fastener can be another fastening means such as a magnet. Still further it shall be appreciated that the attachment member could in other designs attach to different parts of the CED, as illustrated in subsequent FIGS.

Figure 24A:
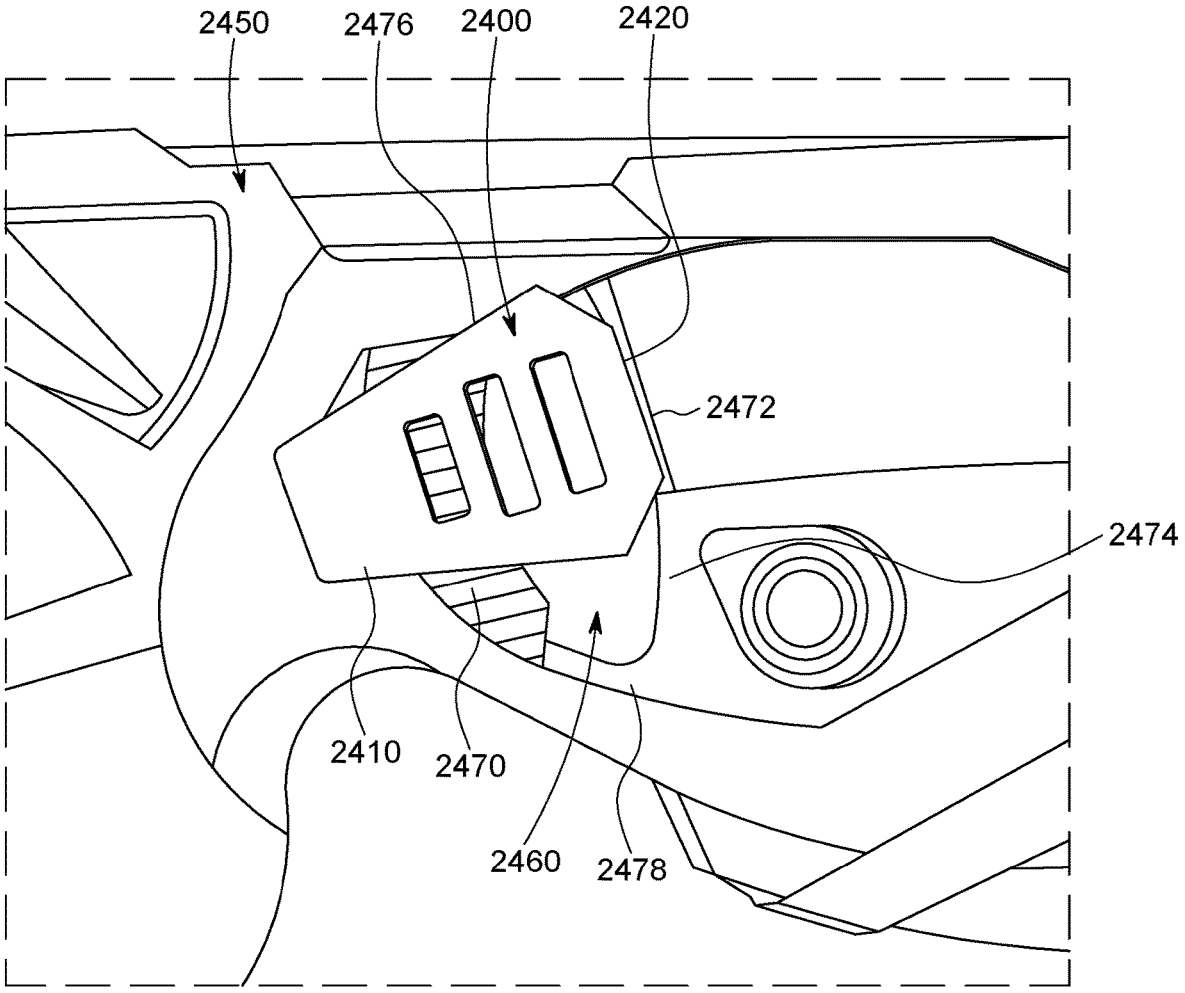
FIG. 24A is a closeup illustration of another exemplary TRD installed into a CED.

FIG. 24A is a closeup illustration of another exemplary TRD 2400 embodiment installed into a CED 2450 having slightly oversized trigger well 2460. The TRD 2400 is seen to be smaller than the size of the trigger well 2460, yet its blocking member 2410 is long and large enough to effectively block (right hand finger) operation of the trigger 2470. The fastener (obscured) on the attachment member 2420 is attached, adhered to upper front wall 2472 of the trigger well 2460. Depending on the shape of the trigger well 2460, lower front wall 2474 can alternately function to provide an adequate surface area for contact with the adhesive contact section 2430. The trigger well's interior surface surrounding the trigger 2470 is bounded by several surfaces, shown here as upper front wall 2472, lower front wall 2474, bottom wall 2478 and upper wall 2476. The term wall here may not actually describe a wall per se but describes the trigger well's interior opening being bounded by surfaces, of which one or more may provide an adhesion-capable surface for TRD attachment.

Figure 24B:
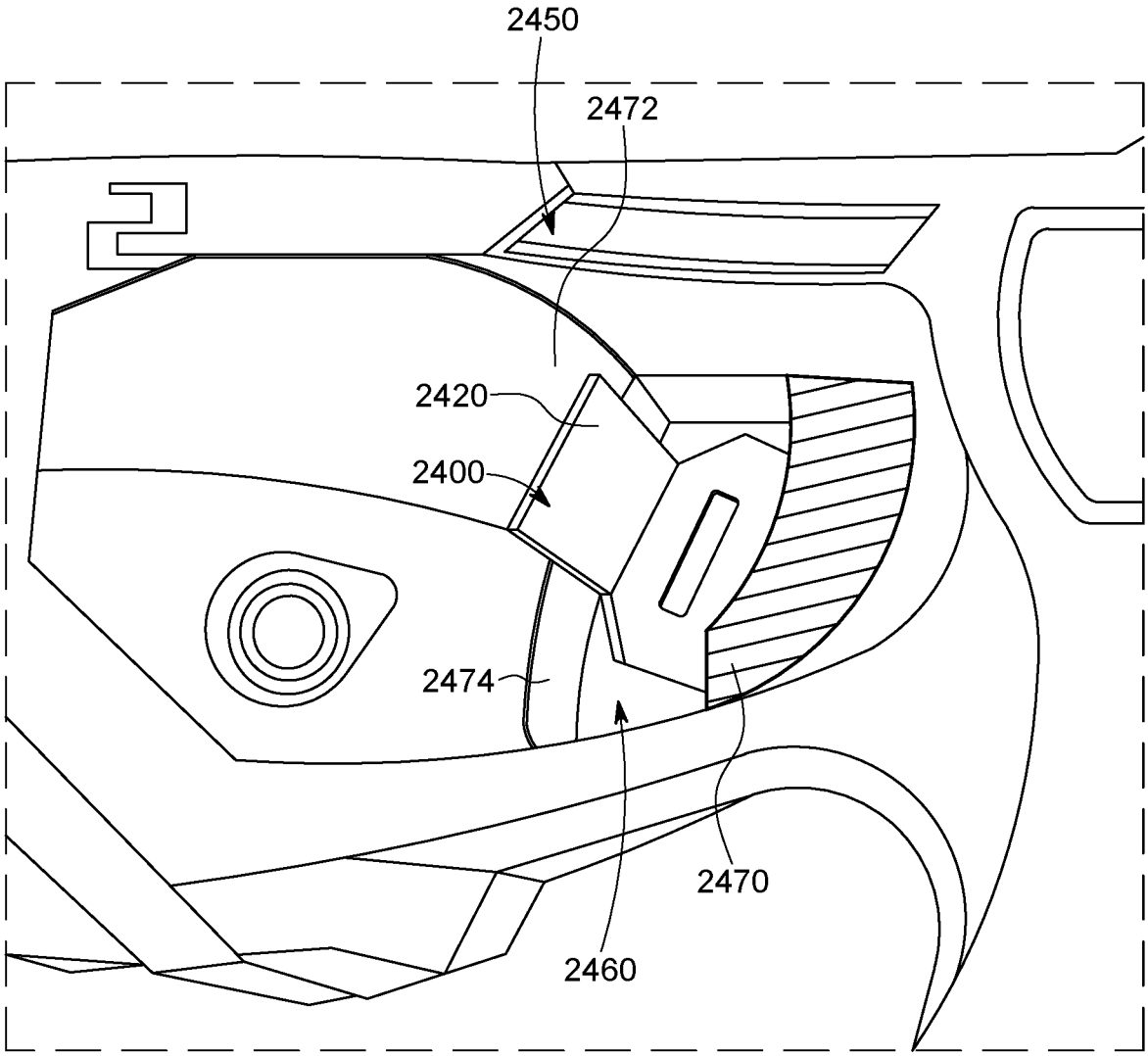
FIG. 24B is an illustration of a reverse side of the CED of FIG. 24A, with the TRD installed.

FIG. 24B is an illustration of a reverse side of the CED 2450 of FIG. 24A, with TRD 2400 installed on CED 2450. This reverse view better illustrates the attachment of attachment member 2420 to the top front wall 2472 of the trigger well 2460. As can be seen, trigger 2470 is open to use for a left-handed individual, while blocking finger use for a right-handed individual. TRD 2400 is attached in this example to the top front wall 2474. Depending on the curvature and profile of the bottom front wall 2474, the TRD 2400 can be attached thereto instead of to the top front wall 2472. Choice of which of any wall to attach is dependent on the size and/or shape of the trigger well of the CED. Here it is evident, a sufficient attachment location is at the top front wall 2472.

Figure 25:
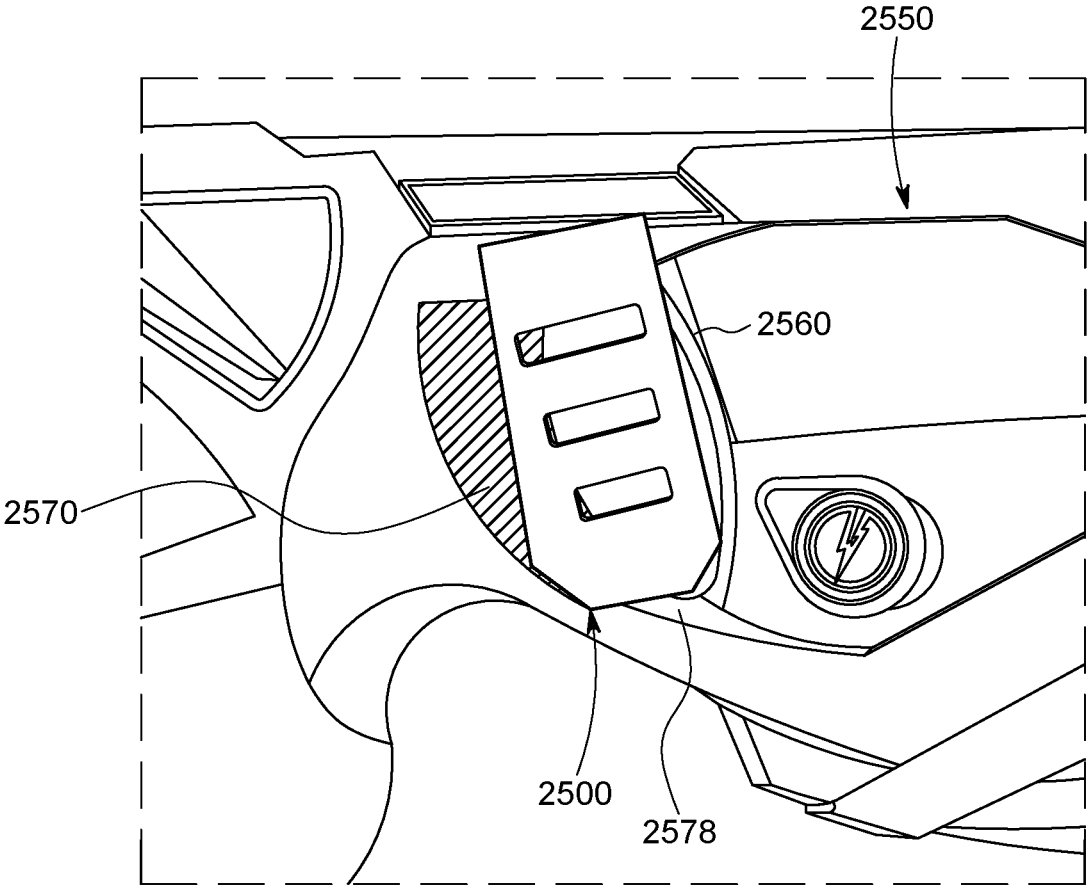
FIG. 25 is an illustration of another exemplary TRD attached to a bottom wall of a CED's trigger well.

FIG. 25 is an illustration of another exemplary TRD 2500 being adhesively attached to a bottom wall 2578 of a CED 2550's trigger well (obscured from view). The positioning is such that the TRD's blocking member 2560 extends "upwards" to cover the face of the trigger well and a major portion of the trigger 2570. This embodiment illustrates a different trigger wall attachment approach as well as shows a more rectangular shaped blocking member 2560. Also, the attachment member (not visible) may be one or more of off-centered, offset, and skewed angle from the blocking member 2560 to attach to a given wall. If a TRD is perhaps too large to not fit within a trigger well via a desired attachment wall, it can be reoriented to attach to another wall, for example a bottom wall 2578 as shown here or even a top wall.

Figure 26:
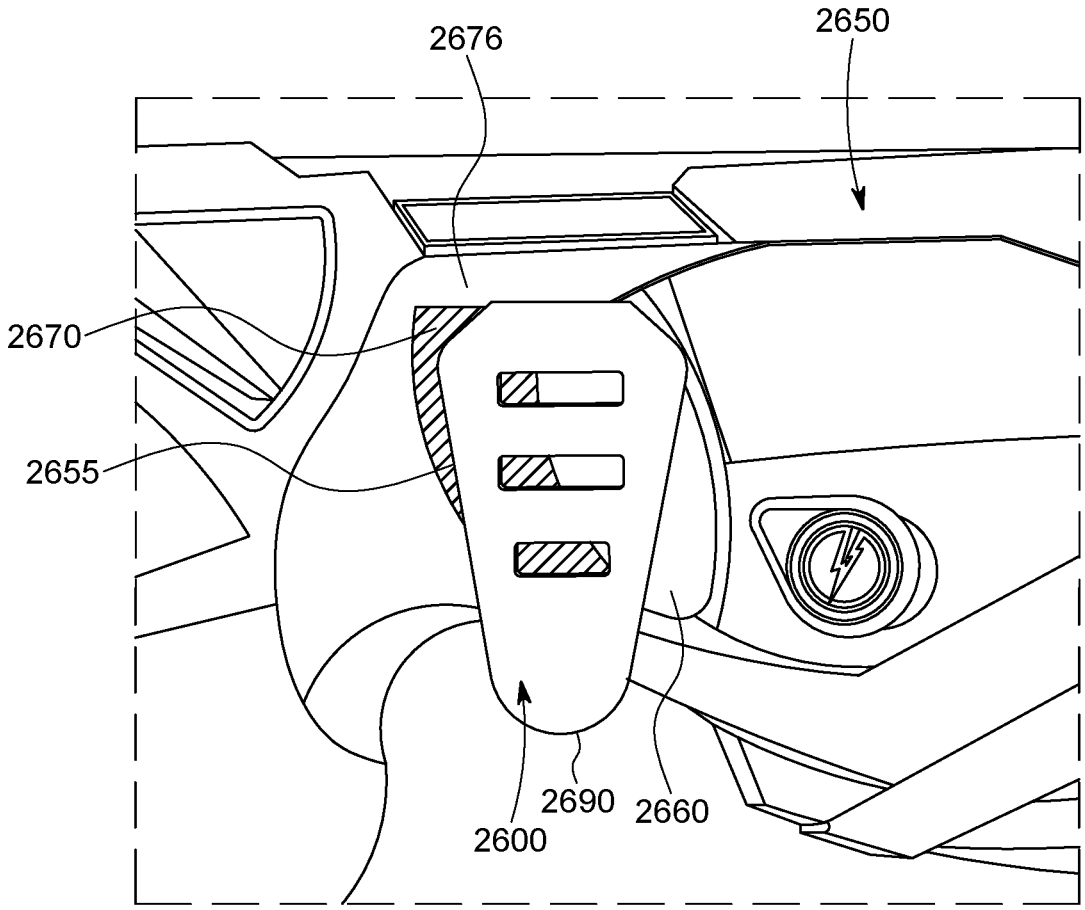
FIG. 26 is an illustration of another exemplary TRD attached to a top wall of a CED's trigger well.

FIG. 26 is an illustration of another exemplary TRD 2600 adhesively attached to a top wall 2676 of a trigger well 2660 of CED 2650. Here, we can see blocking member 2655 of TRD 2600 extending down past the bottom of the trigger well 2660 and substantially covering the trigger 2670, a front of the trigger well 2660 being shown but blocked from right hand use. As in FIG. 25, the attachment member (not visible) may be one or more of off-centered, offset, and skewed angle from the blocking member 2660 to attach to a given wall. This embodiment illustrates a different trigger wall attachment approach as well as shows a more rounded end to the blocking member 2690.

As is apparent from the above embodiments, the placement of the TDB from one side of the trigger well can be switched by rotating the TRD so as to fit on the opposite side, if so desired. Also, various shapes and sizes may be devised for exemplary TRDs utilizing a contact surface on the attachment member, also referable as top member, fastening member, upper arm. These variations permit attachment within a wall of the trigger well, wherein the wall selection may also vary according to trigger well size and shape, and TRD size and shape. As one non-limiting example, a TRD maybe devised wherein a width of the attachment member is greater than the width of the blocking member. This would enable a greater contact/adhesion surface.

It is also understood that while not illustrated here, it is contemplated that the TRD may be integrated into a CED. That is, a CED having a TRD built into it may be devised.

While this invention has been described in conjunction with the specific embodiments outlined above, it is evident that many alternatives, modifications and variations will be apparent to those skilled in the art. Accordingly, the preferred embodiments of the invention, as set forth above, are intended to be illustrative, not limiting. Various changes and combinations thereof may be made without departing from the spirit and scope of this invention. It should be apparent that various different modifications can be made to the exemplary embodiments described herein without departing from the scope and spirit of this invention disclosure. When structures are identified as a means to perform a function, the identification is intended to include all structures, which can perform the function specified.

What is claimed is:

1. A trigger restriction device for use with a conducted energy device (CED), the CED having a trigger, a first side and a second side and further having a trigger well defining a trigger well opening from the first side to the second side, the trigger well having an inside wall, wherein fingers on a primary hand or a non-primary hand of a user of the CED are able engage the trigger via the trigger well, comprising:

a blocking member having two sides and a length and a width, wherein the length is greater than the width and the length is greater than a width of the trigger well opening, wherein one side of the two sides is a finger blocking side;

an attachment member integrally joined to the blocking member and oriented non-parallel to the blocking member, the attachment member having an outer surface contiguous to the finger blocking side of the blocking member, wherein the blocking member and attachment member are a single integral unitary structure having a fixed shape, and wherein a length of the attachment member is smaller than the length of the blocking member and a largest width of the attachment member is smaller than a largest width of the blocking member;

an adhering fastener disposed on the outer surface of the attachment member, the adhering fastener being operably configured to attach only to the inside wall of the trigger well when the device is in use; and, wherein when the device is in use the blocking member is operably configured to block a portion of the trigger well opening on the first side of the CED, wherein the fingers of the primary hand of the user is prevented from accessing the trigger well from the first side of the CED while allowing the fingers of the non-primary hand of the user to access to the trigger well from the second side of the CED.

2. The trigger restriction device of claim 1, wherein the adhering fastener is at least one of a magnet, adhesive, adhesive tape, double-sided adhesive tape, and foam-backed adhesive tape.

3. The trigger restriction device of claim 1, wherein the attachment member is oriented approximately 90 degrees from the blocking member.

4. The trigger restriction device of claim 1, wherein at least one of the blocking member and attachment member are planar in form.

5. The trigger restriction device of claim 1, wherein the blocking member and attachment member are integrally formed from a single material.

6. The trigger restriction device of claim 1, wherein the blocking member and attachment member are formed from at least one of resin, plastic, rubber, nylon, and metal.

7. The trigger restriction device of claim 1, further comprising one or more openings in the blocking member.

8. A trigger restriction device for use with a conducted energy device (CED), the CED having a trigger well opening with two opposing sides, the trigger restriction device comprising:

a blocking arm having a blocking side, a length and width, wherein the length is greater than the width;

an upper arm integrally connected perpendicular to a top end of the blocking arm, wherein the blocking arm and the upper arm are a single fixed unit; and a top surface of the upper arm contiguous to the blocking side and containing an adhering contact section configured to adhere the device to only an inside of a trigger well when the upper arm is placed against a wall of the trigger well, wherein the trigger restriction device when attached to the trigger well wall, the blocking member extends over the trigger well to block access to the trigger well on one side of the CED while allowing access to the trigger well on an opposing side of the CED.

9. The trigger restriction device of claim 8, wherein the adhering contact section is at least one of a magnet, adhesive, adhesive tape, double-sided adhesive tape, and foam-backed adhesive tape.

10. The trigger restriction device of claim 8, wherein at least one of the blocking arm is wider than the upper arm and at least one of the blocking arm and upper arm are planar in form.

11. The trigger restriction device of claim 8, wherein the blocking arm and upper arm are integrally formed from a single material.

12. The trigger restriction device of claim 8, wherein the blocking arm and upper arm are formed from at least one of resin, plastic, rubber, nylon, and metal.

13. A method of training non-primary hand use of a conducted energy device (CED), the CED having a trigger, a primary hand side and a non-primary hand side and further having a trigger well defining a trigger well opening from the primary hand side to the non-primary hand side, the trigger well having an inside wall, wherein fingers of a user of the CED are able engage the trigger via the trigger well, comprising:

forming a unitary single piece non-primary hand training device from at least one of a resin, plastic, rubber, nylon, and metal material, having a trigger well blocking member and an integral attachment member, wherein the attachment member has an outer surface with an adhesive fastening element configured for securement to an inside surface of the trigger well, when the non-primary hand training device is installed;

orienting the non-primary hand training device so the blocking member is facing a primary hand side of the user and the outer surface of the attachment member is proximal to the inside surface of the trigger well; and attaching the adhesive fastening element to only the inside surface of the trigger well, wherein the method prevents use of the CED with a primary hand of the user, so as to train the user to use their non-primary hand for CED operation.

14. The method of claim 13, wherein the attaching is via use of at least one of a magnet, adhesive tape, double-sided adhesive tape, and foam-backed adhesive tape.

15. The method of claim 13, wherein the trigger well blocking member is longer than the attachment member, and the trigger well blocking member is positioned to extend past the trigger well opening.

16. The method of claim 13, wherein the trigger well blocking member and attachment member are formed as planar members.

17. The method of claim 13, wherein the non-primary hand training device is formed to have an L shape.

18. The method of claim 13, wherein the attaching is a not of a permanent means.

19. A trigger restriction device for use with a conducted energy device (CED), the CED having a trigger, a first side and a second side and further having a trigger well defining a trigger well opening from the first side to the second side, the trigger well having an inside wall, comprising:

a blocking member having a first surface and an opposing inner second surface, a first end and an opposing distal second end, a first edge and an opposing second edge, wherein a length is defined between the first and second ends, wherein a width is defined between the first and second edges, wherein the length is greater than the width;

an attachment member having a third surface and an opposing inner fourth surface, a third end and an opposing distal fourth end, a third edge and an opposing fourth edge, an attachment member length being defined between the third end and the fourth end, wherein the attachment member being integrally joined to the blocking member wherein the third end is adjacent to the first end, wherein the first surface of the blocking member and the third surface are contiguous, wherein the attachment member is in fixed position non-parallel to the blocking member, wherein the attachment member length dimension is less than the length of the blocking member, wherein a largest width of the attachment member is smaller than a largest width of the blocking member; and an adhesion-based fastener disposed on the third surface of the attachment member, the adhesion-based fastener being operably configured to attach only to the inside wall of the trigger well when the device is in use, wherein when the device is in use the blocking member is operably configured to block a portion of the trigger well opening on the first side of the CED, wherein the fingers of the primary hand of the user is prevented from accessing the trigger well from the first side of the CED while allowing the fingers of the non-primary hand of the user to access to the trigger well from the second side of the CED.

20. The trigger restriction device of claim 19, wherein the adhesion-based fastener is at least one of a magnet, adhesive tape, double-sided adhesive tape, and foam-backed adhesive tape.

* * * * *